US009352239B2

(12) United States Patent
Hohns et al.

(10) Patent No.: US 9,352,239 B2
(45) **Date of Patent: *May 31, 2016**

(54) TOY SURFBOARD

(71) Applicant: Toyosity, LLC, Windermere, FL (US)

(72) Inventors: William Hohns, Windermere, FL (US); Marcellus Rambo Benson, Jr., Merritt Island, FL (US)

(73) Assignee: Toyosity, LLC, Windermere, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/550,440

(22) Filed: Nov. 21, 2014

(65) Prior Publication Data

US 2015/0079873 A1 Mar. 19, 2015

Related U.S. Application Data

(63) Continuation-in-part of application No. 13/788,355, filed on Mar. 7, 2013, now Pat. No. 8,894,460, and a continuation-in-part of application No. 29/447,627, filed on Mar. 5, 2013, now Pat. No. Des. 711,485.

(60) Provisional application No. 61/647,910, filed on May 16, 2012.

(51) Int. Cl.
*A63H 23/10* (2006.01)
*A63H 3/26* (2006.01)

(52) U.S. Cl.
CPC . *A63H 23/10* (2013.01); *A63H 3/26* (2013.01)

(58) Field of Classification Search
USPC ..... 446/153, 155, 156, 160; 441/65, 74, 79; 273/441
See application file for complete search history.

(56) References Cited

U.S. PATENT DOCUMENTS

| | | | |
|---|---|---|---|
| 954,544 | A | 4/1910 | Sanford |
| 1,399,855 | A | 12/1921 | Fierlein |
| 1,758,289 | A | 5/1930 | Loy |
| D133,078 | S | 7/1942 | Lee |
| D168,807 | S | 2/1953 | Reuther |
| 3,160,897 | A | 12/1964 | Kelly |
| 3,721,038 | A | 3/1973 | Viczena |

(Continued)

FOREIGN PATENT DOCUMENTS

| | | |
|---|---|---|
| WO | 8809286 | 12/1988 |
| WO | 9948581 | 9/1999 |

OTHER PUBLICATIONS

Thompson, J.L., Toy Surfboard, PCT/US2013/040510, PCT Search Report mailed on Aug. 12, 2013, 12 pages.

(Continued)

*Primary Examiner* — Kurt Fernstrom
(74) *Attorney, Agent, or Firm* — Brian S. Steinberger; Law Offices of Brian S. Steinberger, P.A.

(57) ABSTRACT

Toy surfboards and methods of snapping together a figurine with a surfboard and a skeg and a wing to form a surfboard toy. The assembled toy can ride incoming waves back to a shore. The hydrofoil can have a V or boomerang shape with side wings having ends extending rearward and out from the surfboard. Wing ends can incorporate curved discs for stability. Optional stabilizing tail/fin/rudder can extend rearward from the hydrofoil. Games can include racing toys by tossing them simultaneously from the shore to see which one reaches the shore first.

18 Claims, 30 Drawing Sheets

(56) References Cited

U.S. PATENT DOCUMENTS

| | | | | |
|---|---|---|---|---|
| 3,871,127 | A | 3/1975 | Heath | |
| 4,320,546 | A | 3/1982 | Knox | |
| 4,768,988 | A | 9/1988 | Rutter | |
| 4,802,429 | A | 2/1989 | Butka | |
| 4,857,025 | A | 8/1989 | Brown | |
| 4,923,427 | A | 5/1990 | Roland | |
| D312,491 | S | 11/1990 | Roland | |
| 4,968,273 | A | 11/1990 | Momot | |
| 5,063,869 | A | 11/1991 | Bielefeldt | |
| 5,069,648 | A | 12/1991 | Ozeki | |
| D324,706 | S | 3/1992 | Gibson | |
| D424,569 | S | 5/2000 | Augusta | |
| 6,167,829 | B1 | 1/2001 | Lang | |
| 6,183,333 | B1 | 2/2001 | Hall | |
| D455,186 | S | 4/2002 | Koester | |
| 6,478,650 | B1 * | 11/2002 | Tsai | 446/102 |
| 6,551,157 | B1 | 4/2003 | Bishop | |
| 6,692,321 | B2 | 2/2004 | Metrot | |
| 6,699,091 | B1 | 3/2004 | Warner | |
| D496,491 | S | 9/2004 | Chen | |
| 6,793,552 | B2 | 9/2004 | Derrah | |
| D498,559 | S | 11/2004 | Pan | |
| D515,684 | S | 2/2006 | Latone | |
| D560,030 | S | 1/2008 | Welch | |
| 7,401,786 | B2 | 7/2008 | Lochtefeld | |
| 8,894,463 | B2 * | 11/2014 | Chan et al. | 446/268 |
| 2005/0109257 | A1 | 5/2005 | Lang et al. | |

OTHER PUBLICATIONS

Toyosity, LLC, Toy Surfboard, Chinese Application/Patent No: 201380024950.1, Filed Nov. 11, 2014, Notice on the First Office Action (PCT Application in the National Phase), mailed on Dec. 30, 2015, 19 pages.

* cited by examiner

TOY SURFBOARD

CROSS REFERENCE TO RELATED APPLICATIONS

This application is a Continuation-In-Part of U.S. patent application Ser. No. 13/788,355 filed Mar. 7, 2013, now U.S. Pat. No. 8,894,460 issued, Nov. 25, 2014, which claims the benefit of priority to U.S. Provisional Patent Application Ser. No. 61/647,910 filed May 16, 2012 and U.S. Design patent application Ser. No. 29/447,627 filed Mar. 5, 2013, now U.S. Design Pat. No. D711,485 issued Aug. 19, 2014. The entire disclosure of each of the applications listed in this paragraph are incorporated herein by specific reference thereto.

FIELD OF INVENTION

This invention relates to toys, and in particular to toy surfboard devices, apparatus and methods of playing a game with a figurine mounted on a surfboard and a hydrofoil rudder underneath the board for allowing the surfboard to ride incoming waves back to a shoreline.

BACKGROUND AND PRIOR ART

Popular marketed water toys over the years have generally included balls and blow up toys which may be fun to some but would have limited fun to surfers. Traditional many toys, such as dolls and the like, may also sink in the water or float out to sea, both of which would not be desirable. The inventor is not aware of any marketed surfboard toys that would be popular with surfers and beachgoers that is able to take advantage of the direction and power of incoming waves found along ocean and large lake shorelines.

A check of the U.S. Patent Office database has shown that some patents on toy type surfboards have been proposed in years past. See for example, U.S. Patents: U.S. Pat. No. Des. 312,491 to Roland; U.S. Pat. No. Des. 324,706 to Gibson, and U.S. Pat. No. 4,923,427 to Roland.

Although both Roland patents reference having heavy keels/fins, these toys are primarily for show. The downwardly protruding keels/fins would have difficulty in balancing the toy surfboard and keeping the surfboard in an upright position in the water.

Gibson '706 shows a surfer doll on top of a toy surfboard. The large mass of the doll compared to the thin toy board and single fin would not be able to balance in the water and would not be able to ride waves coming to shore at a beach. The top heavy doll would undoubtably cause the toy to capsize if used in the water without someone's hand holding the toy upright.

Furthermore, there is a good chance that Gibson '706 and possibly the Roland products would end up floating away and not being able to return to the shoreline which could result in the loss of these toys.

Thus, the need exists for solutions to the above problems with the prior art.

SUMMARY OF THE INVENTION

A primary objective of the present invention is to provide toy surfboard devices, apparatus and methods of playing a game with a figurine mounted on a surfboard and a hydrofoil rudder underneath the board for allowing the surfboard to ride incoming waves back to a shoreline.

A secondary objective of the present invention is to provide toy surfboard devices, apparatus and methods of playing a game, having a buoyant surfboard with a weighted hydrofoil which offsets the weight of a figurine mounted on the board which is able to continuously float on water in an upright position.

A third objective of the present invention is to provide toy surfboard devices, apparatus and methods of playing a game, having figurines that can interchangeably be mounted to the top of the surfboard.

A fourth objective of the present invention is to provide toy surfboard devices, apparatus and methods of playing a game with a figurine mounted on a surfboard and a hydrofoil rudder underneath the board, where players can simultaneously toss or throw respective surfboard toy devices, and determine a winner of the first surfboard toy to reach the shoreline.

A fifth objective of the present invention is to provide toy surfboard devices, apparatus and methods, which turns right-side up, points toward the shore after being put into a incoming shore wave, and returns to the shore each time it is used where the toy surfs the wave to the shore.

A sixth objective of the present invention is to provide toy surfboard devices, apparatus and methods, which takes advantage of the waves at a beach, instead of being overwhelmed, where a figurine on the toy stays upright and surfs the waves all the wave to the shore.

A seventh objective of the present invention is to provide toy surfboard devices, apparatus and methods, having a figurine, surfboard, skeg and wing (hydrofoil) which can be in separate pieces that easily snap together when assembled.

An eighth objective of the present invention is to provide toy surfboard devices, apparatus and methods, having a figurine and upper portion of a skeg with mateable attachment points to one another through holes that pass through the board.

A ninth objective of the present invention is to provide toy surfboard devices, apparatus and methods, having figurines with rounded, and non sharp tip edges (such as on hair ends and hand ends) that will not easily break off, and are safe to use.

A tenth objective of the present invention is to provide toy surfboard devices, apparatus and methods, with a hydrofoil (wings) that do not break off when the toy surfboard is stepped upon.

An eleventh objective of the present invention is to provide toy surfboard devices, apparatus and methods, having separate figurine, board, skeg and wing main that when separated can easily be packaged together taking up less space than a fully assembled or partially assembled surfboard toy.

A twelfth objective of the present invention is to provide toy surfboard devices, apparatus and methods, that can perform tricks similar to real surfers in surf and waves through its unique weighting and balancing.

Further objects and advantages of this invention will be apparent from the following detailed description of the presently preferred embodiments which are illustrated schematically in the accompanying drawings.

Second Embodiment

Figure 22:
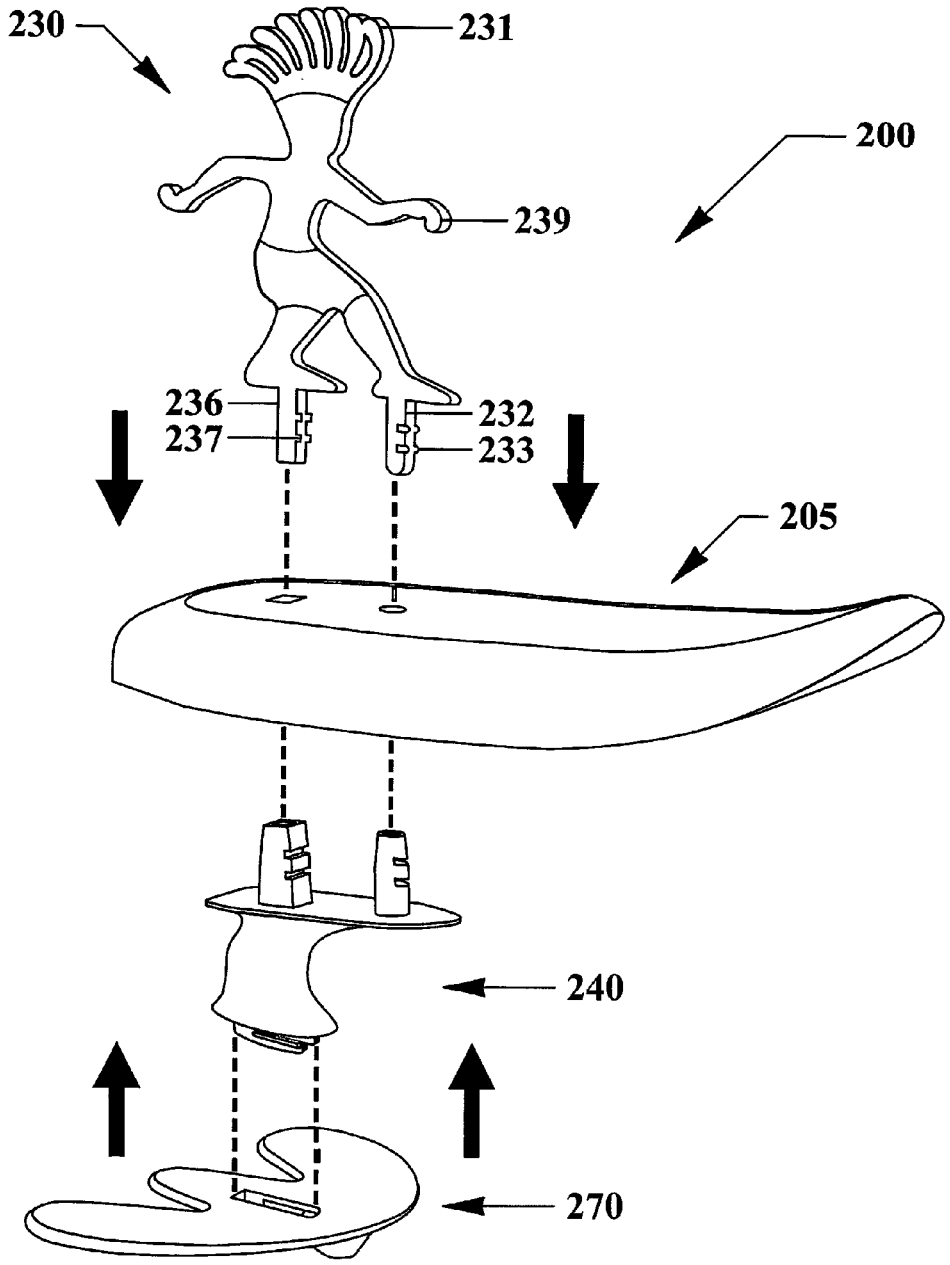

FIG. 22 is an exploded view of another embodiment of the surfboard toy with figurine, board, skeg and main wing (hydrofoil).

Figure 23:
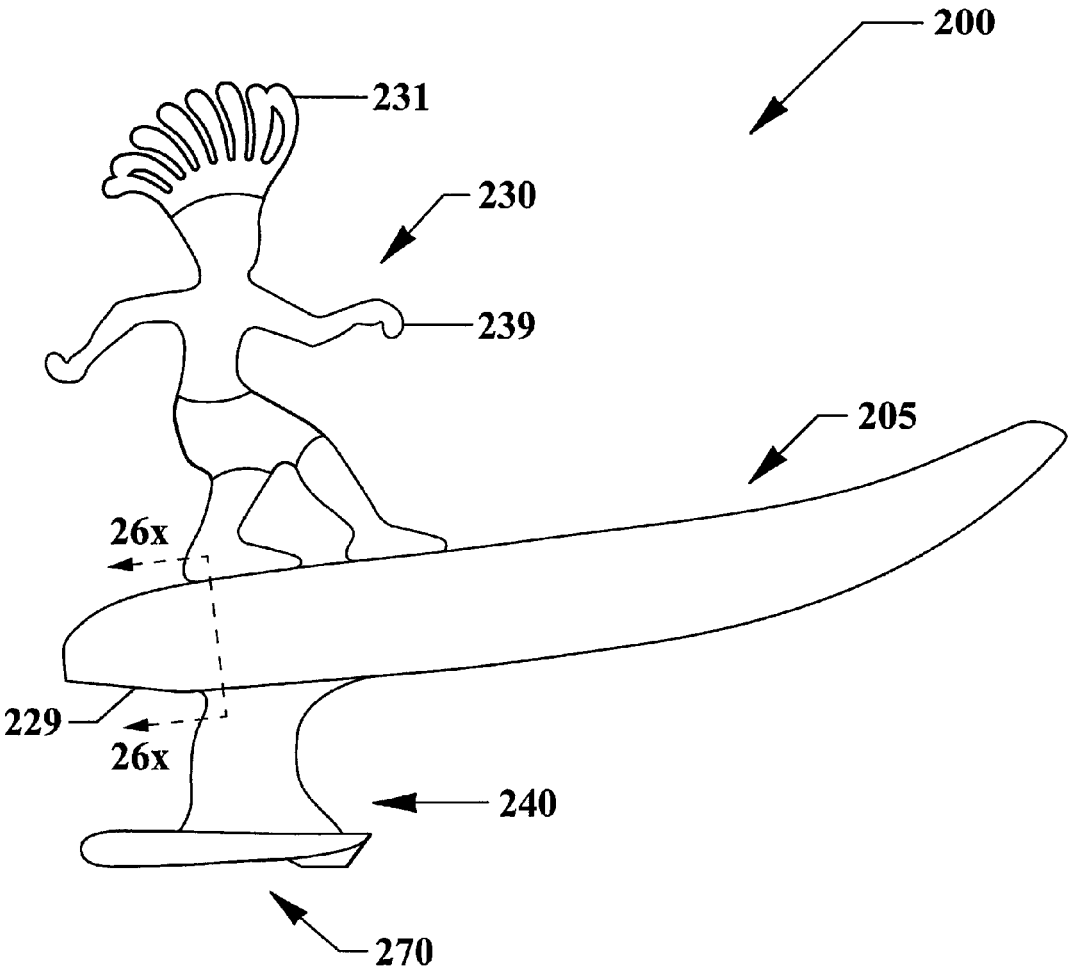

FIG. 23 is a side assembled view of the surfboard toy with figurine, board, skeg and main wing of FIG. 22.

Figure 24:
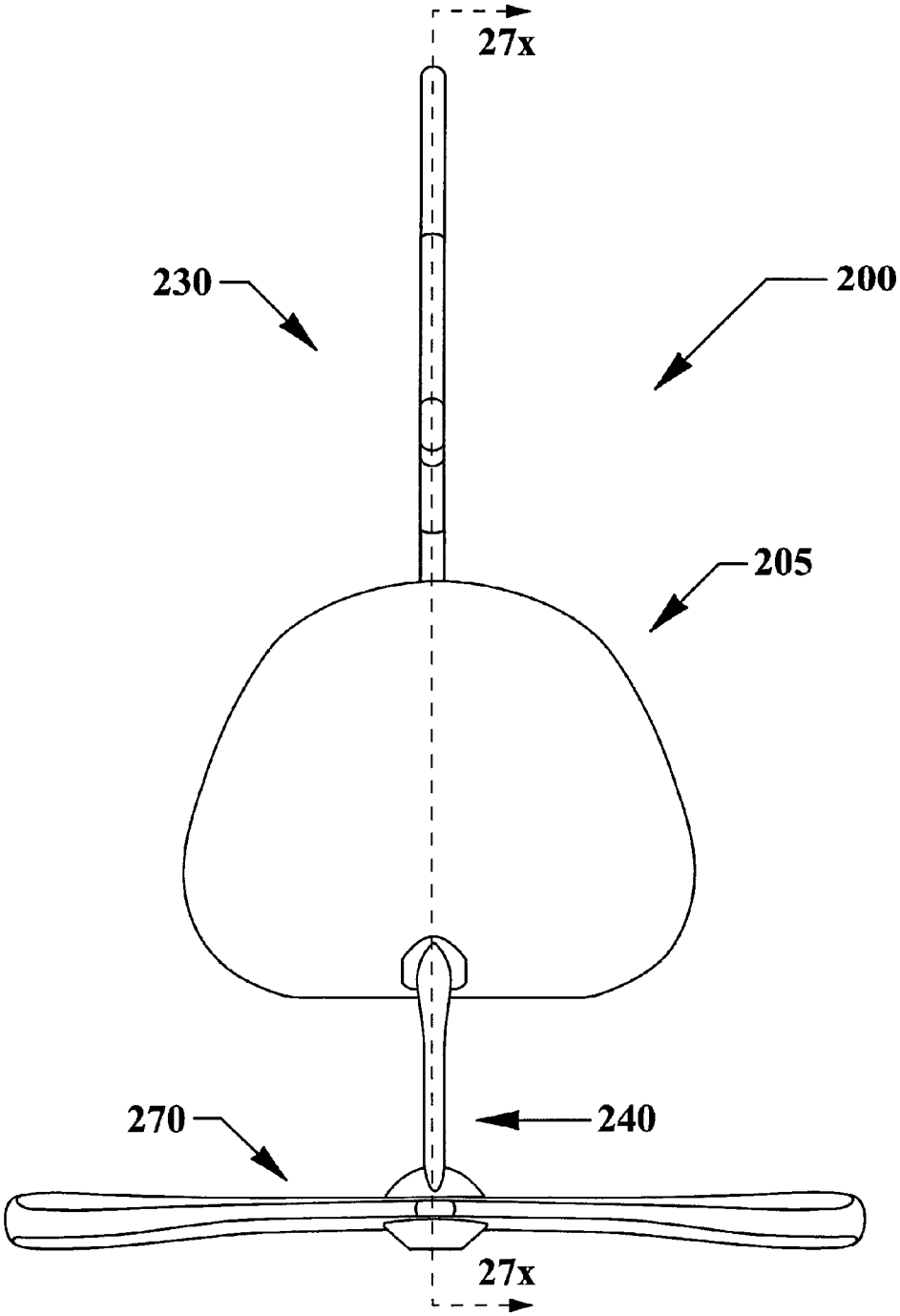

FIG. 24 is a front view of the assembled surfboard toy of FIG. 23.

Figure 25:
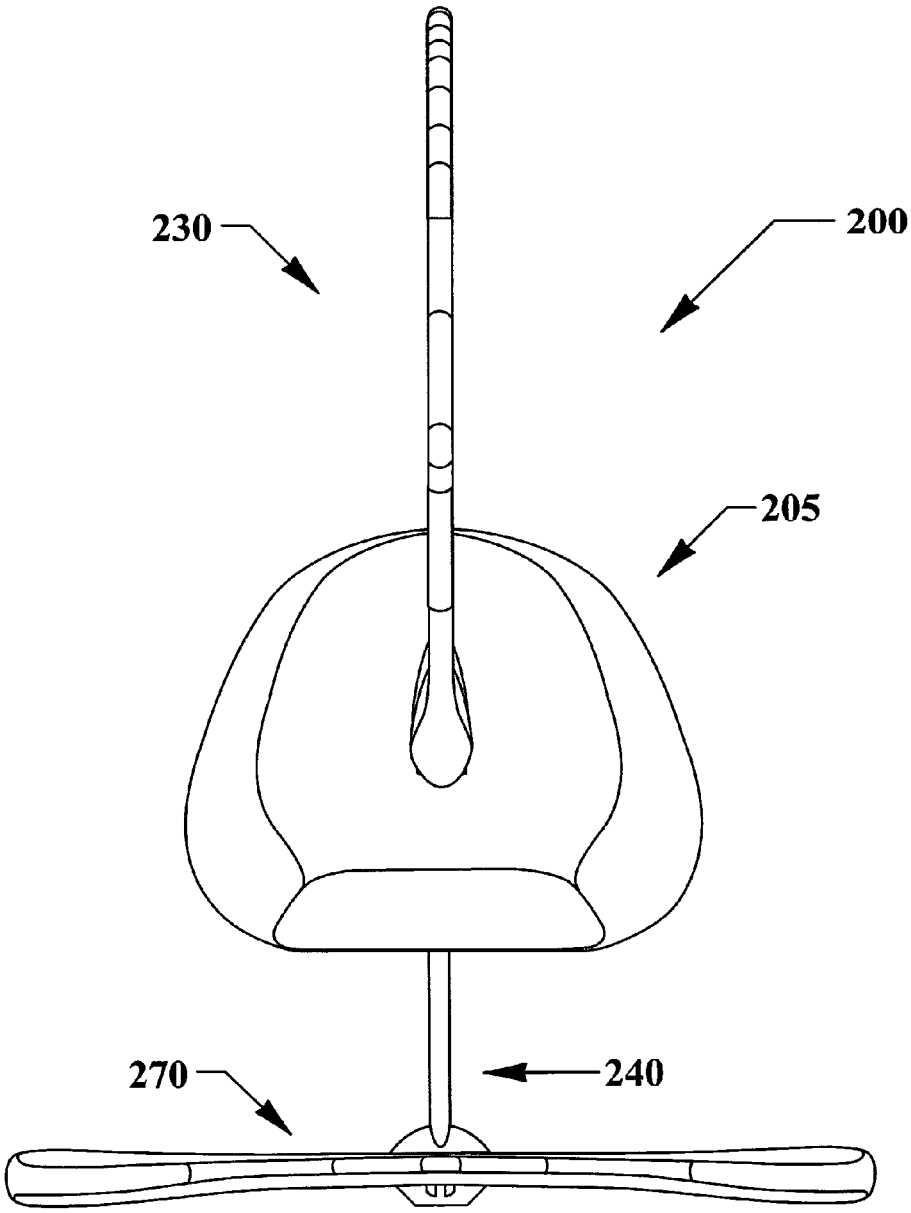

FIG. 25 is a rear view of the assembled surfboard toy of FIG. 23.

Figure 26:
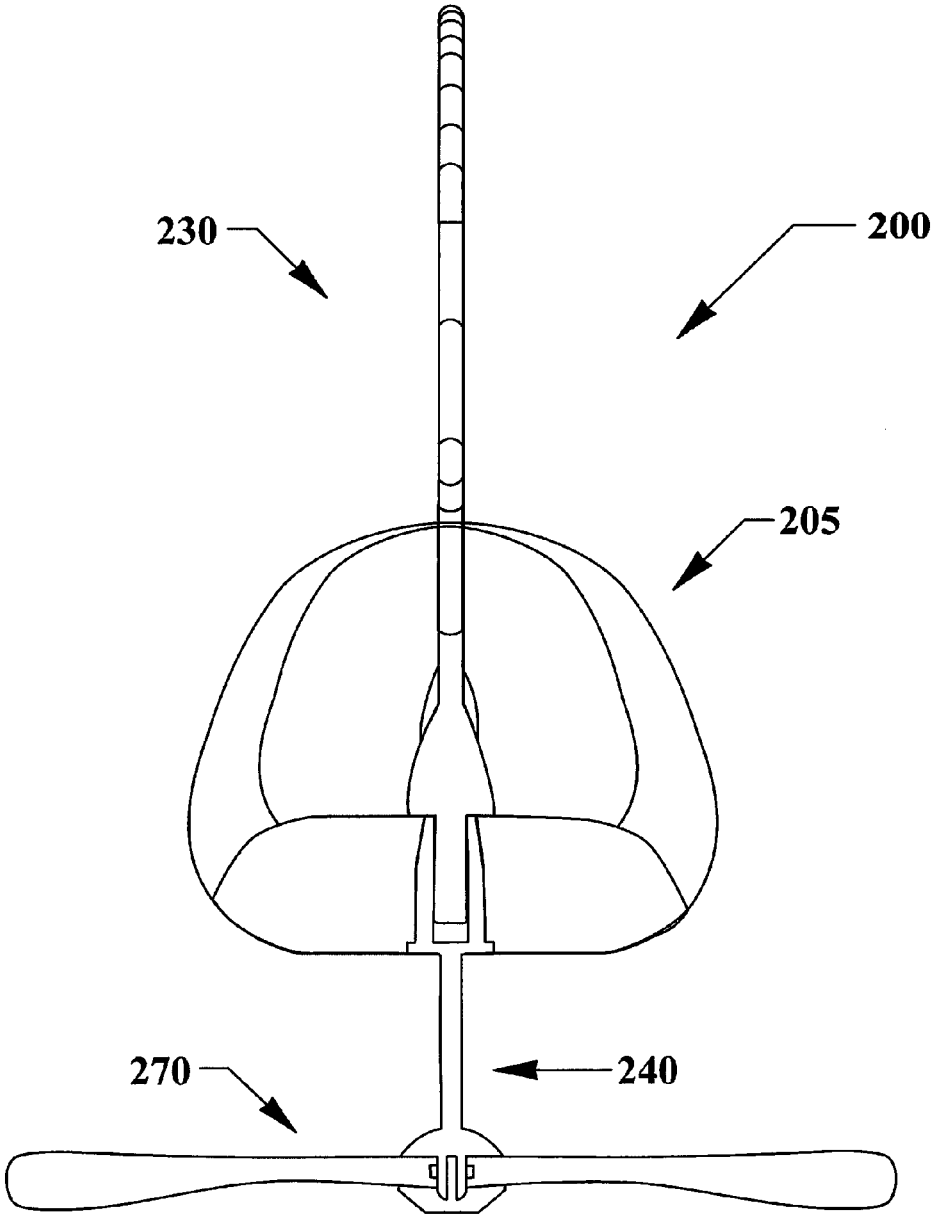

FIG. 26 is a cross-sectional view of the assembled surfboard of FIG. 23 along arrows 26X.

Figure 27:
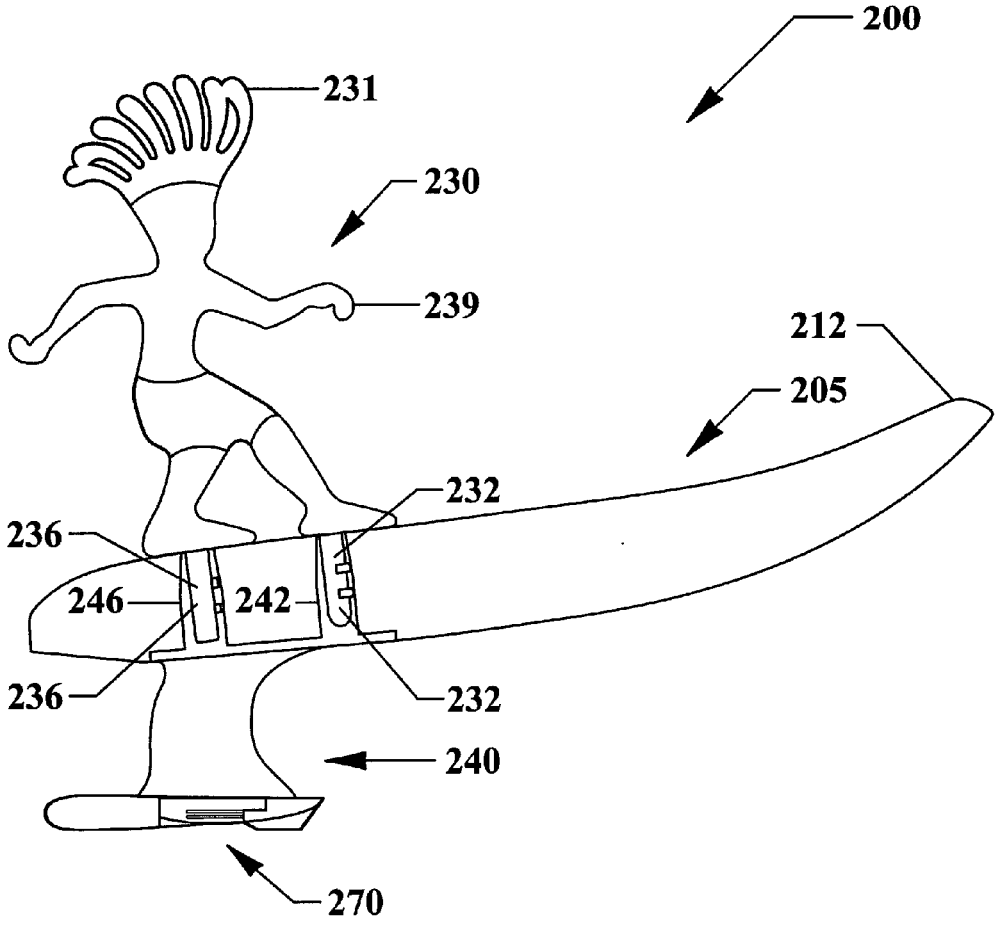

FIG. 27 is a side cross-sectional view of the assembled surfboard of FIG. 24 along arrows 27X.

Figure 28:
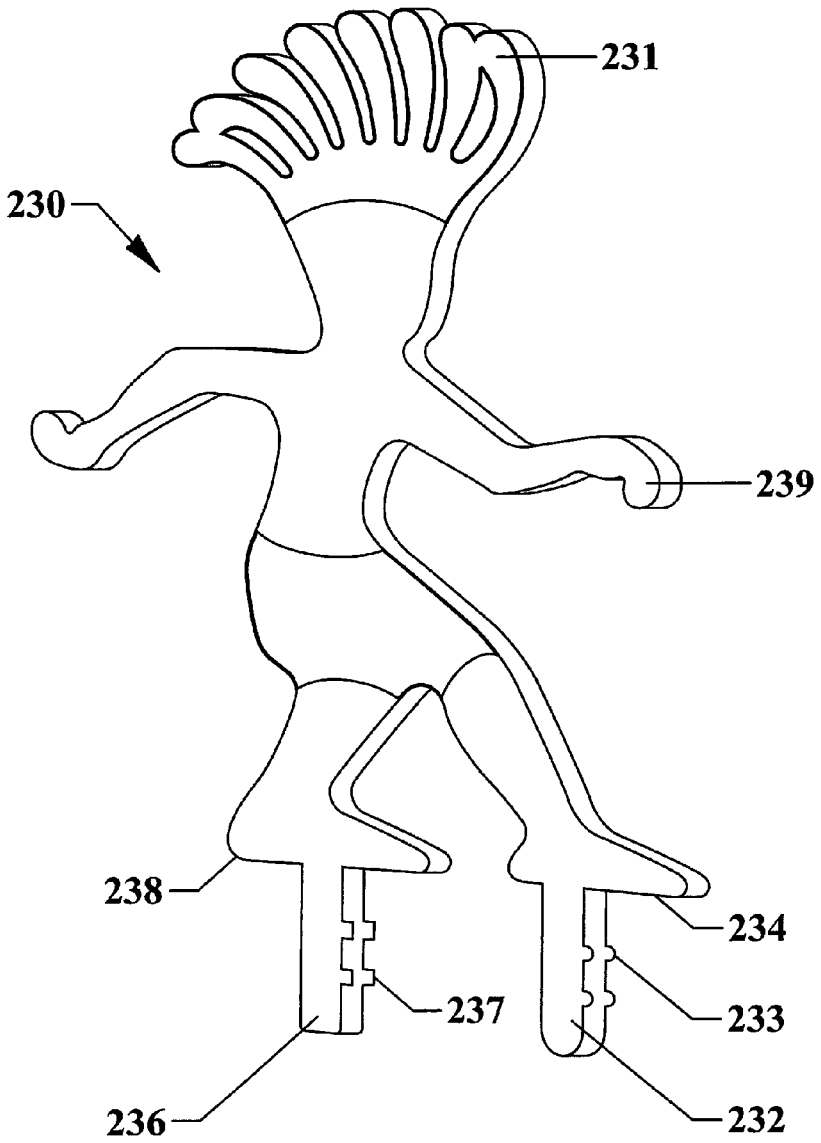

FIG. 28 is an enlarged perspective view of the separated figurine of FIGS. 22-27.

Figure 29:
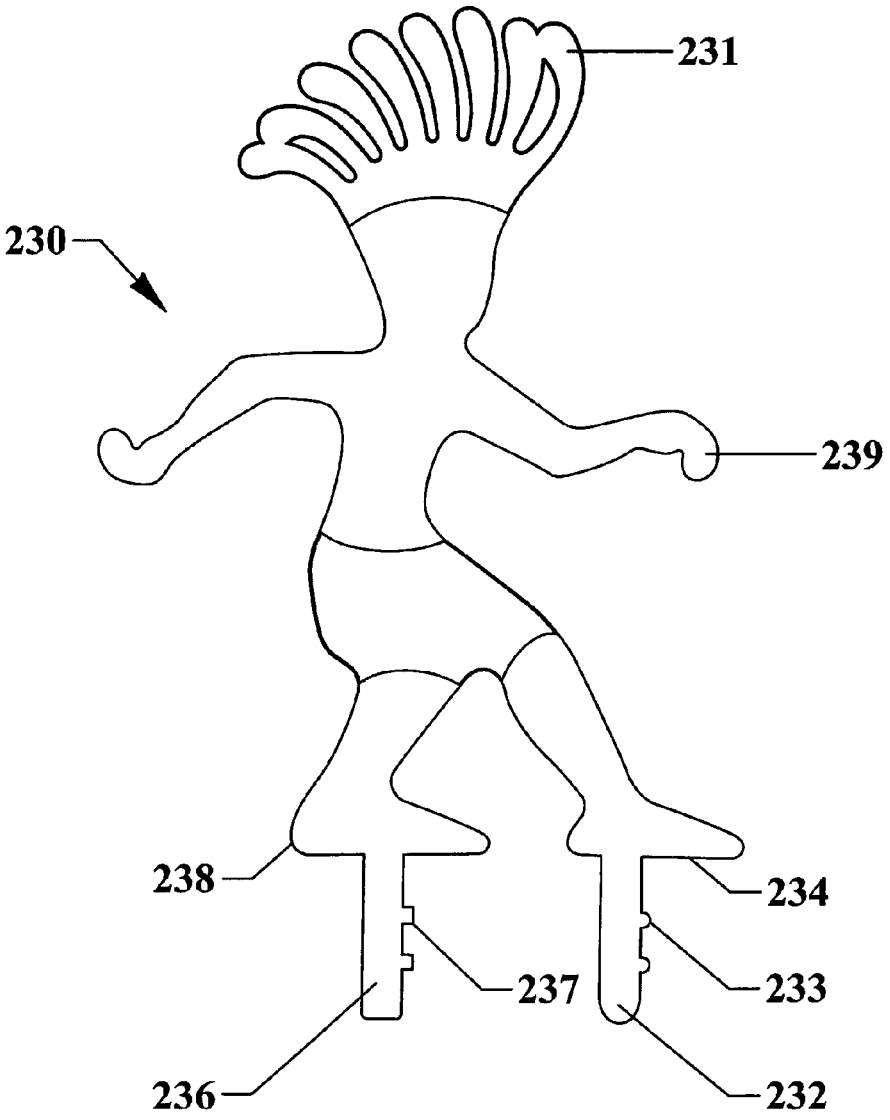

FIG. 29 is a side view of the figurine of FIG. 28.

Figure 30:
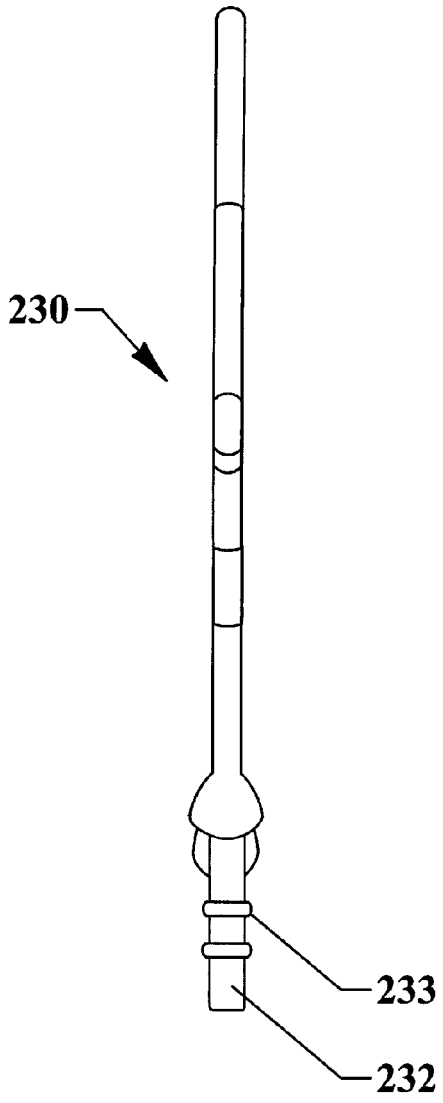

FIG. 30 is a front view of the figurine of FIG. 28.

Figure 31:
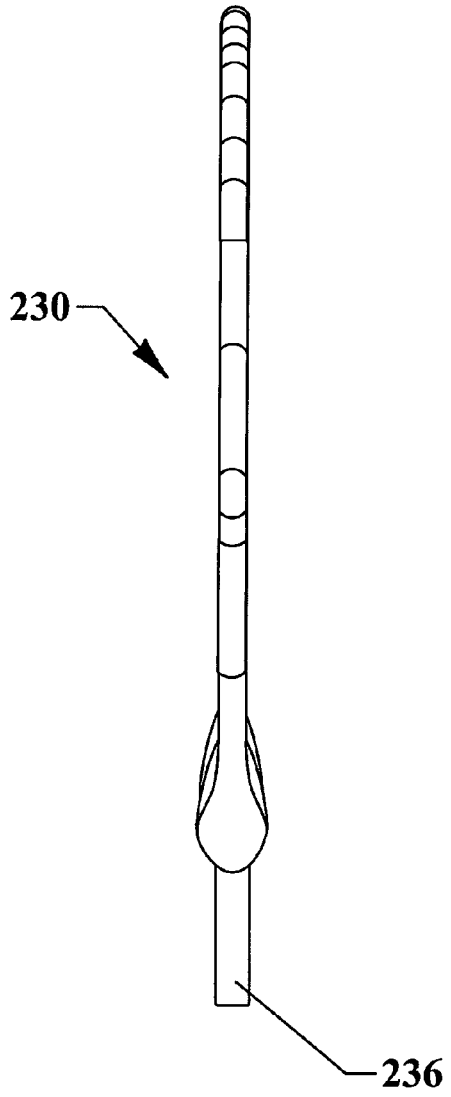

FIG. 31 is a rear view of the figurine of FIG. 28.

Figure 32:
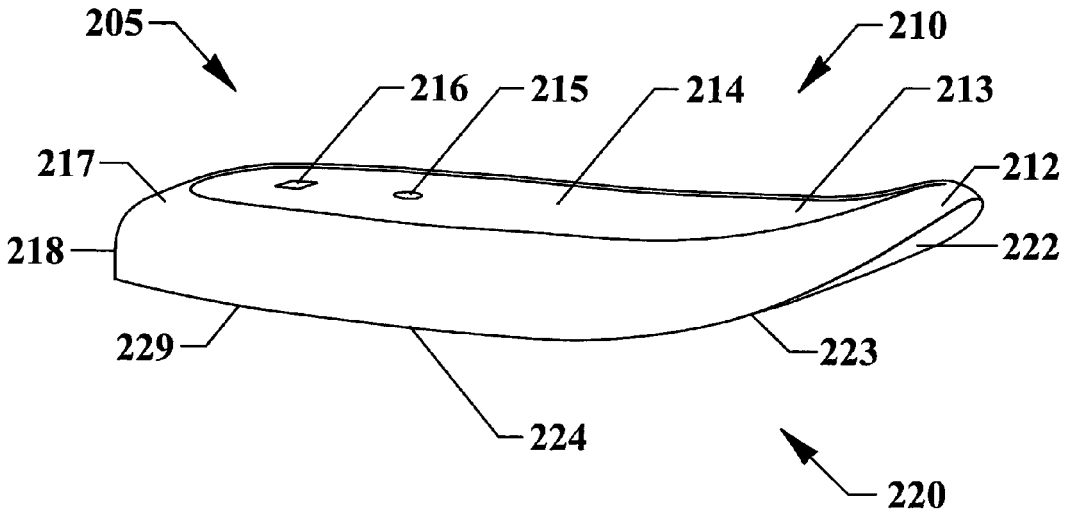

FIG. 32 is an enlarged perspective view of the separated surfboard of FIGS. 22-27.

Figure 33:
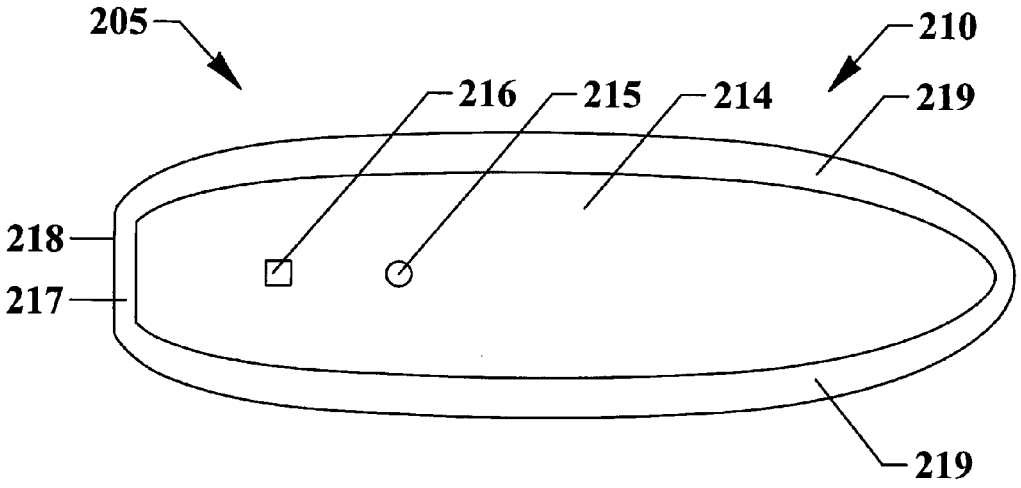

FIG. 33 is a top view of the surfboard of FIG. 32.

Figure 34:
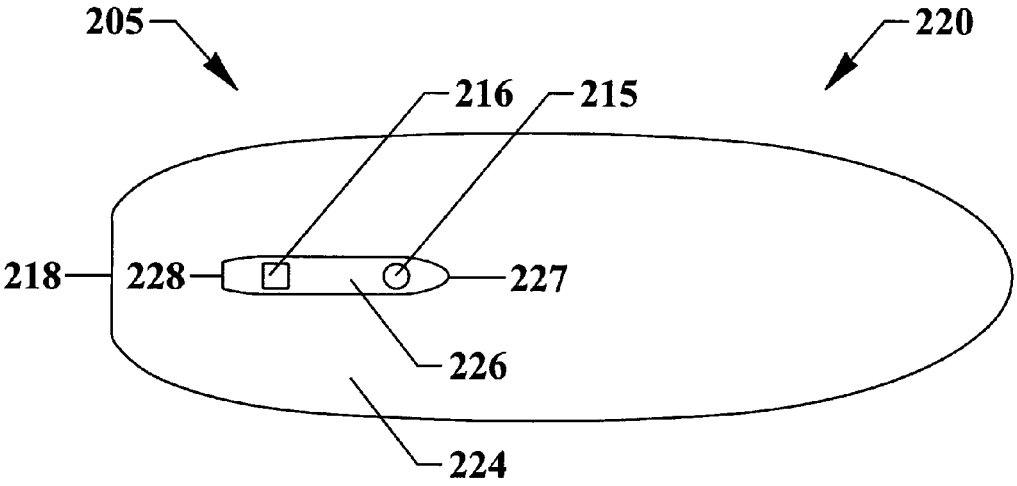

FIG. 34 is a bottom view of the surfboard of FIG. 32.

Figure 35:
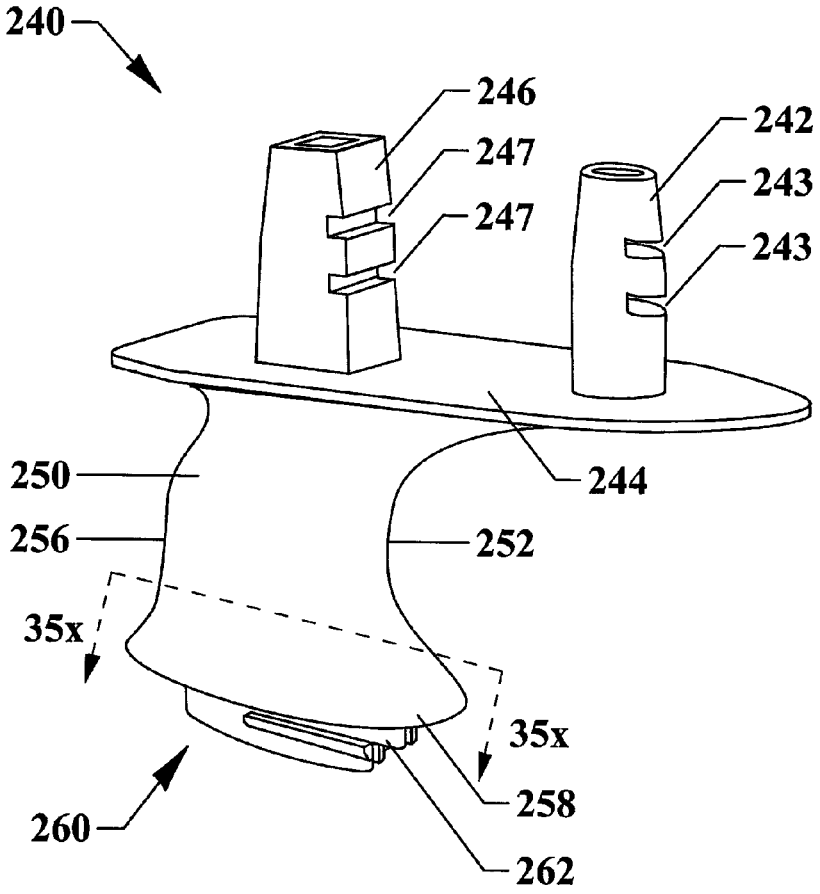

FIG. 35 is an enlarged perspective view of the separated keel/strut member (skeg) of FIGS. 22-27.

Figure 35A:
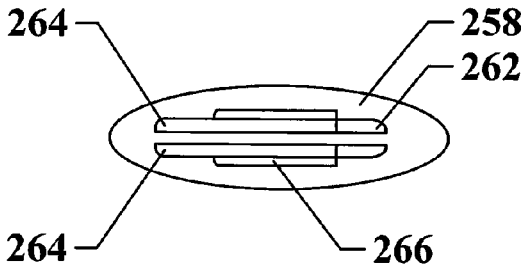

FIG. 35A is a bottom view of the skeg of FIG. 35 along arrow 35X.

Figure 36:
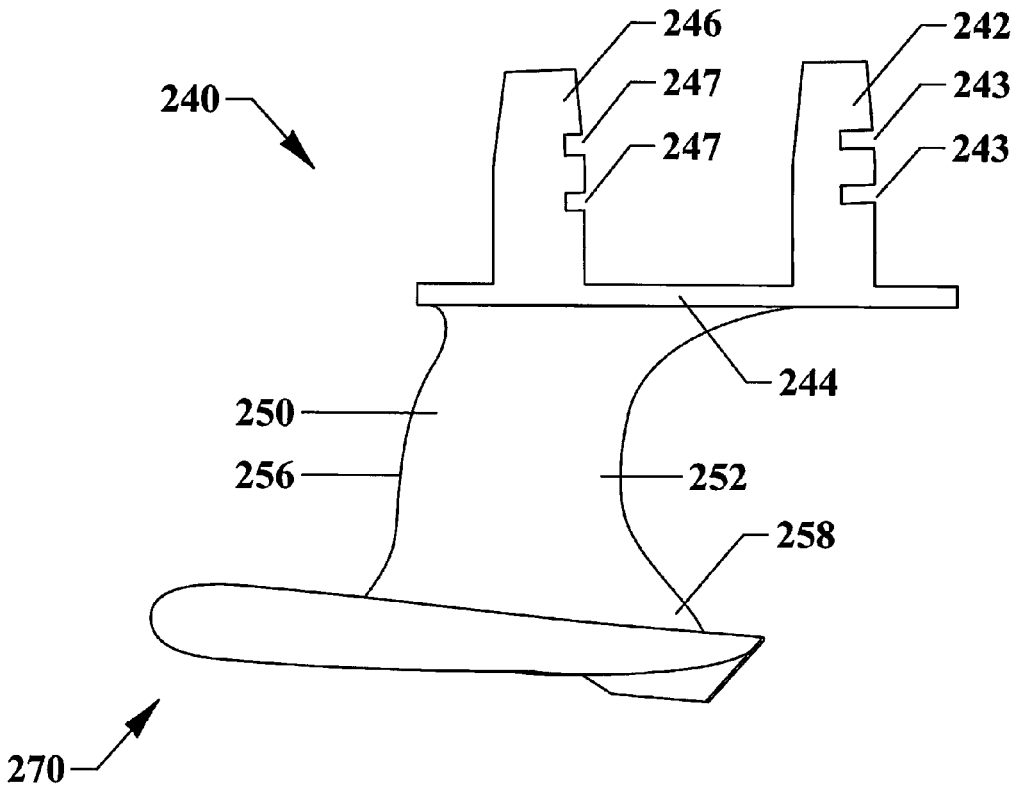

FIG. 36 is a side view of the skeg from FIG. 35 assembled to the separate wing of FIGS. 22-27.

Figure 37:
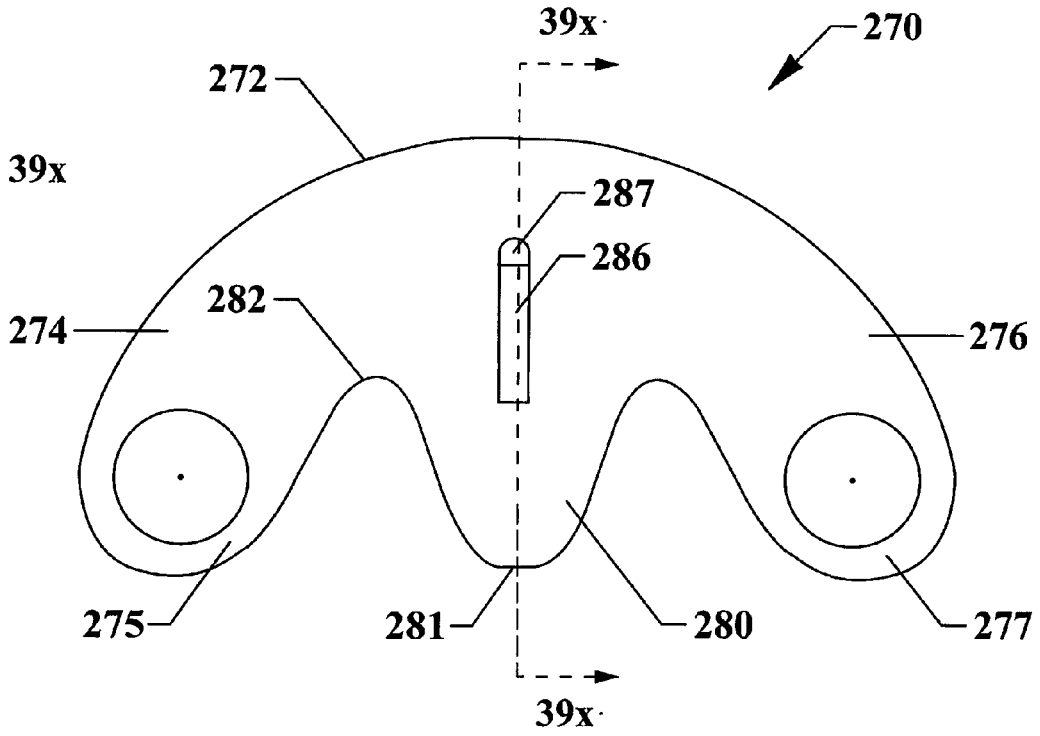

FIG. 37 is a top view of the separate wing of FIGS. 22-27 and 36.

Figure 38:
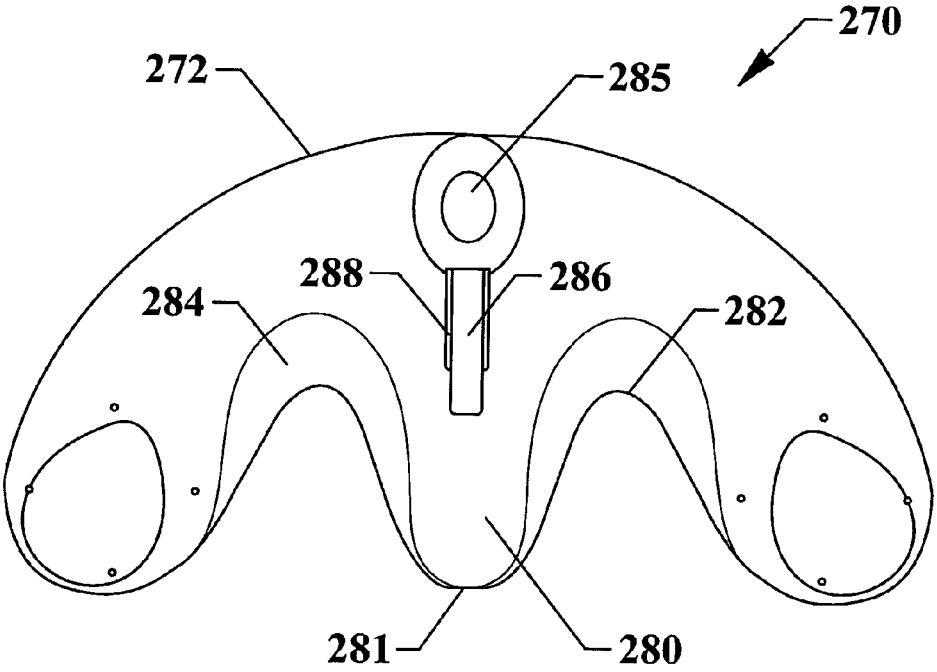

FIG. 38 is a bottom view of the wing of FIG. 37.

Figure 39:
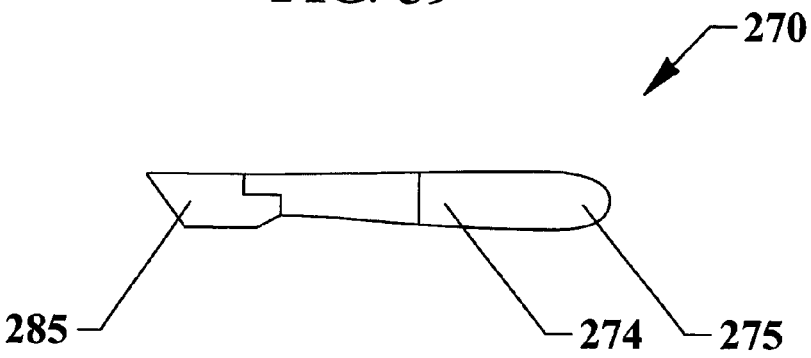

FIG. 39 is a side view of the wing of FIG. 37 along arrow 39X.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of the components referenced in the figures will now be described.

10 Surfboard toy
20 Floatation board
22 front upwardly curving end (nose)
24 top surface
26 bottom surface
28 rear end
30 Surfer figurine
40 Hydrofoil-generally V or boomerang shape (weighted)
42 left wing/vane
44 apex
46 right wing/vane
48 stabilizing tail/rudder
50 wing end stabilizers/weights (curved portions or disc shapes)
60 figurine mounting pegs
70 figurine mounting holes in floatation board
80 Keel/strut member
82 mount tenon (male member)
90 Keel mount mortise in bottom of surfboard
100 Shore surf
110 Small breaking shore wave
120 Person
130 Water line
140 Floatation zone of surfboard toy
150 Pivot point around which Surfer Dude assembly rotates when acted upon by a breaking wave Second Embodiment

200 Second embodiment surfboard toy
205 floatation board

210 top of board
212 front generally beveled tip edge
213 upwardly angling tip
214 generally flat surface
215 front cylindrical through-hole
216 rear square (or rectangular) through-hole
217 rounded beveled upper rear surface edge
218 flat rear end
219 rounded and beveled sides
220 bottom of board
222 flat upwardly angling front surface
223 rounded transition surface
224 generally flat lower surface
226 longitudinal indentation
227 angled tip indentation
228 flat rear indentation
229 slightly upwardly angled rear surface
230 figurine
231 rounded enlarged hair tip ends
232 downwardly extending front cylindrical male peg
233 parallel ribs on front face of front peg
234 flat surface under front foot
236 downwardly extending rear square (or rectangular) male peg
237 parallel ribs on front face of rear peg
238 flat surface under rear foot
239 curved hands
240 skeg
242 upwardly extending front cylindrical tube with socket Upper edge rests generally flush with (or slightly recessed from) upper board surface
243 parallel slits/slots in front face of front tube
244 flat upper ledge surface with narrow tip and flat rear to mateably fit into longitudinal indentation 226 in board bottom 220
246 upwardly extending rear square (or rectangular) tube with socket
Upper edge rests generally flush with upper (or slightly recessed from) board surface
247 parallel slits/slots in front face of rear tube
250 strut portion of skeg
252 front concave curved edge
256 rear convex curved edge
258 enlarged lower footer
260 male connector
262 front split step
264 longitudinal split fin portion
266 longitudinal side rib(s)
270 main wing
272 front convex edge
274 rear extending left wing/vane
275 enlarged rounded (weighted) end
276 rear right wing/vane
277 enlarged rounded (weighted) end
280 central rear extending tail
281 rounded tip end of tail
282 concave root ends of tail
284 sculpted surfaces about concave root ends 282
285 raised footer under front of main wing near apex to allow assembled toy surfboard to be balanced when placed on a flat surface for display purposes
286 through-hole mounting slot
287 front end indentation step in wing top
288 side indentation steps along slot 286 sides in wing bottom

First Embodiment

Figure 1:
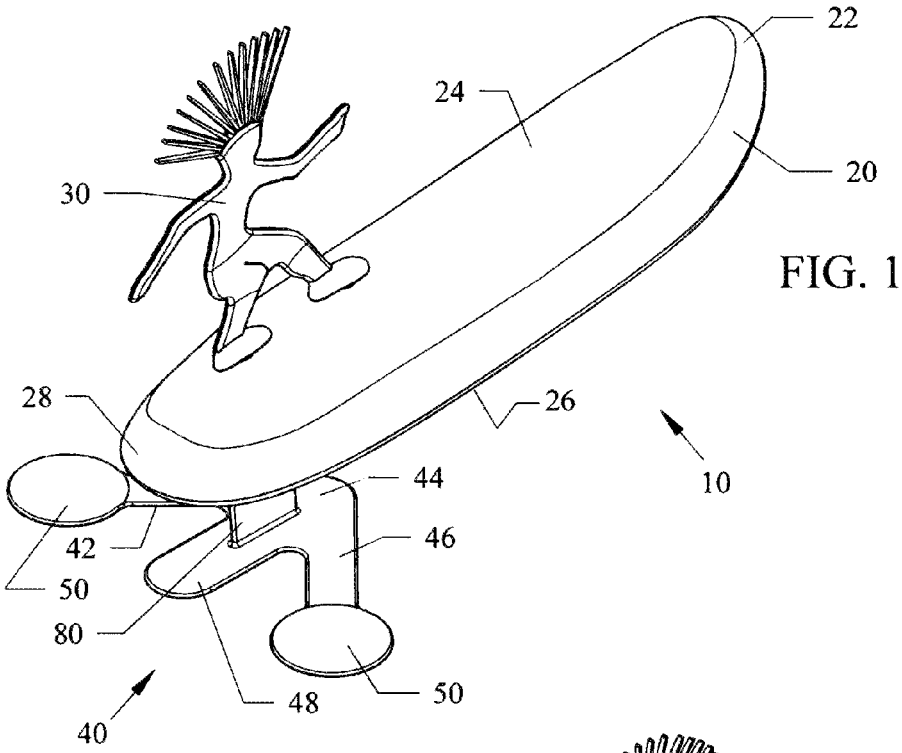
FIG. 1 is a top right perspective view of surfboard toy with mounted figurine and hydrofoil.
Figure 2:
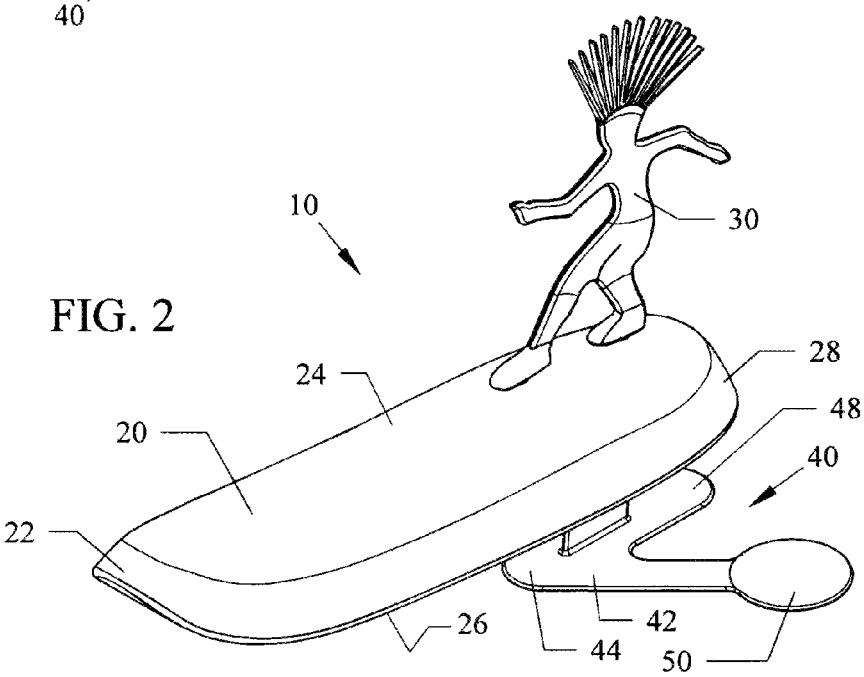
FIG. 2 is a top left perspective view of the surfboard toy of FIG. 1.
Figure 3:
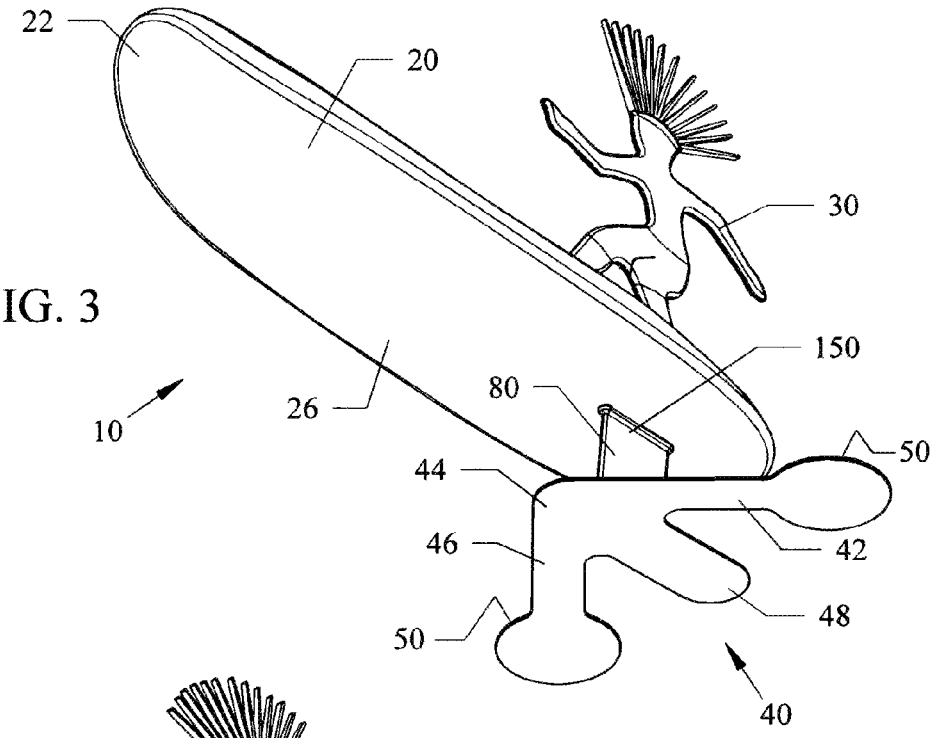
FIG. 3 is a bottom left perspective view of the surfboard toy of FIG. 1.
Figure 4:
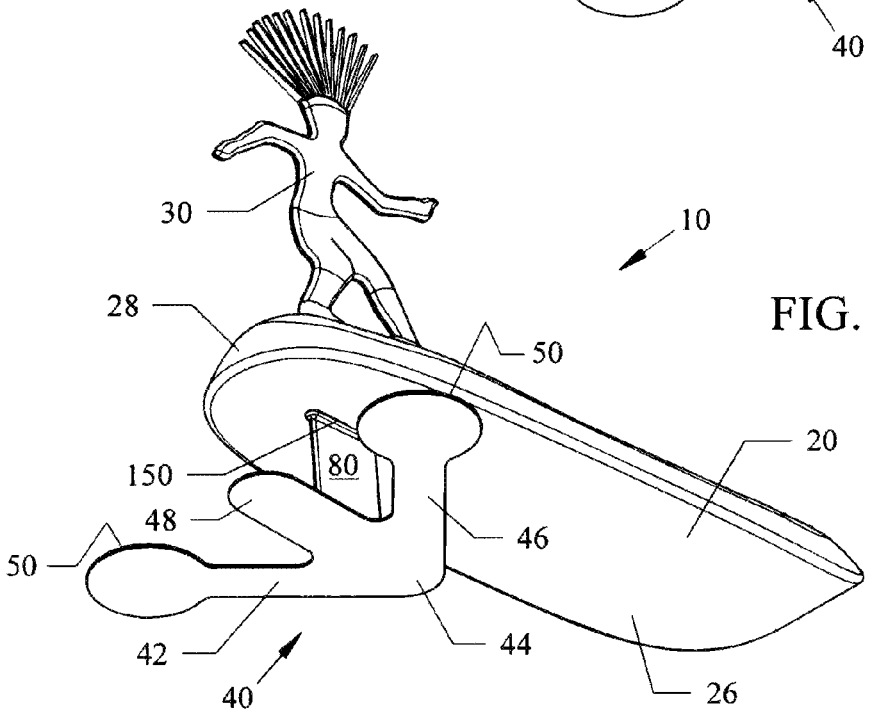
FIG. 4 is a bottom right perspective view of the surfboard toy of FIG. 1.

FIG. 1 is a top right perspective view of surfboard toy 10 having floatation board 20 with mounted figurine 30 and hydrofoil 40. FIG. 2 is a top left perspective view of the surfboard toy 10 of FIG. 1. FIG. 3 is a bottom left perspective view of the surfboard toy 10 of FIG. 1. FIG. 4 is a bottom right perspective view of the surfboard toy 10 of FIG. 1.

Figure 5:
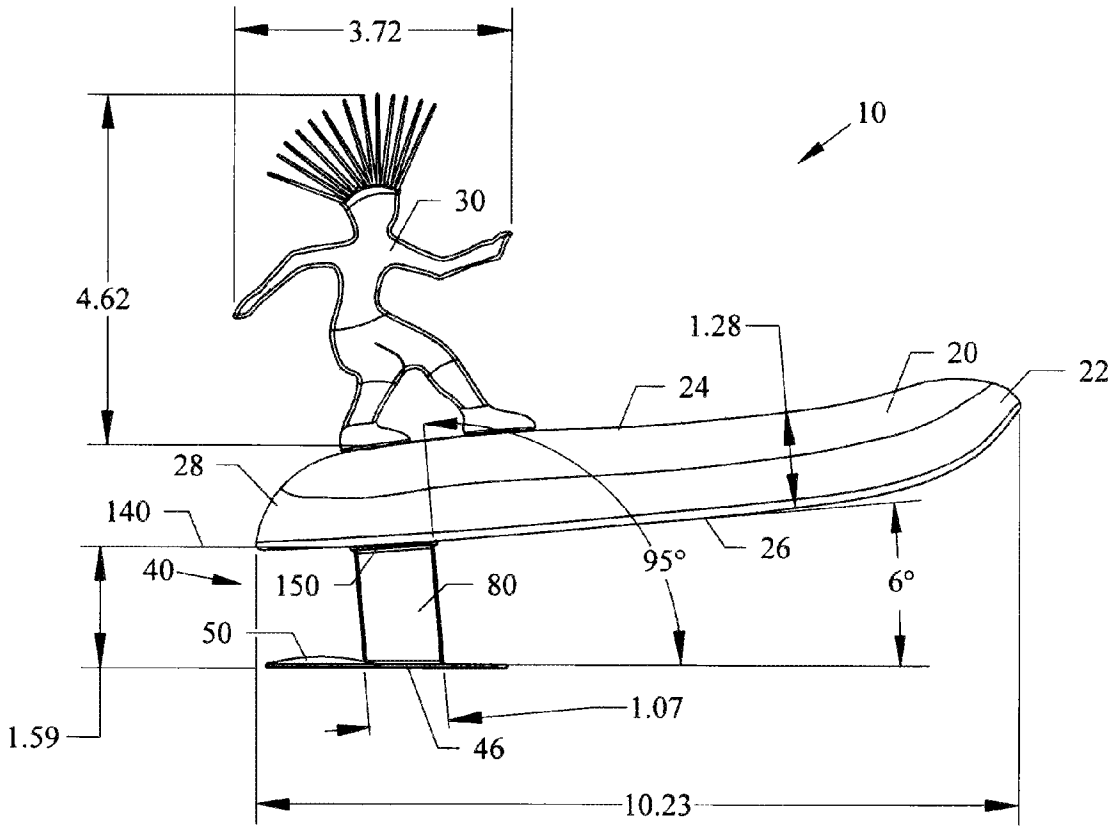
FIG. 5 is a side view of the surfboard toy of FIG. 1.
Figure 6:
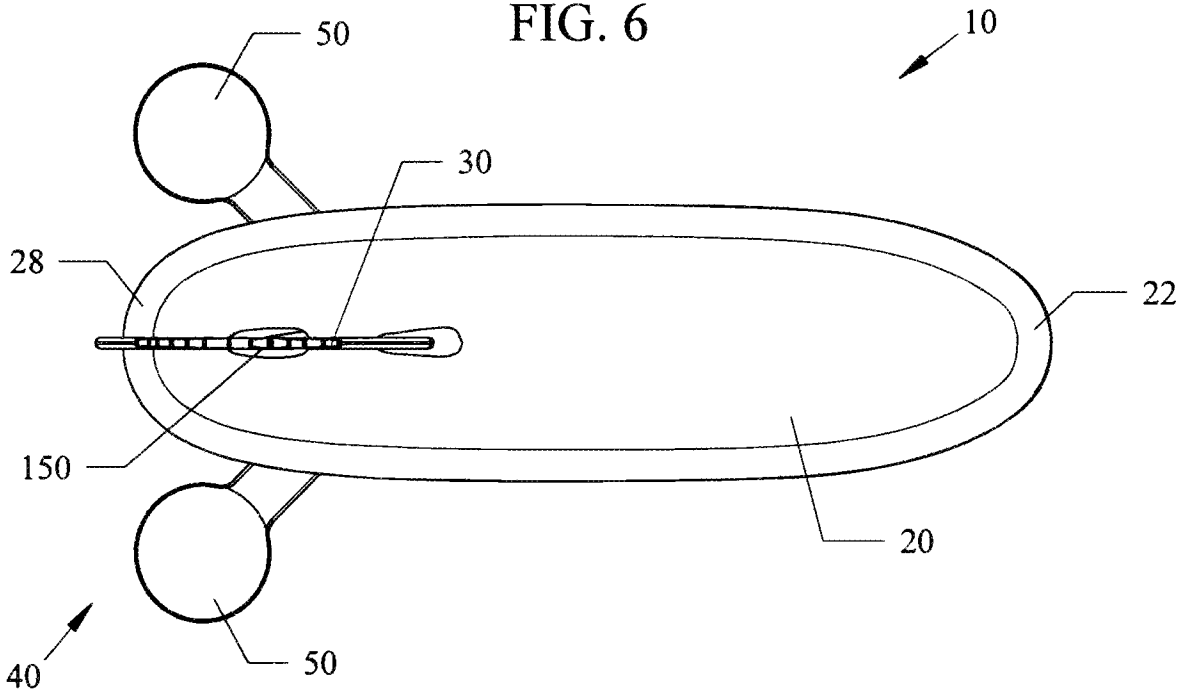
FIG. 6 is a top view of the surfboard toy of FIG. 1.
Figure 7:
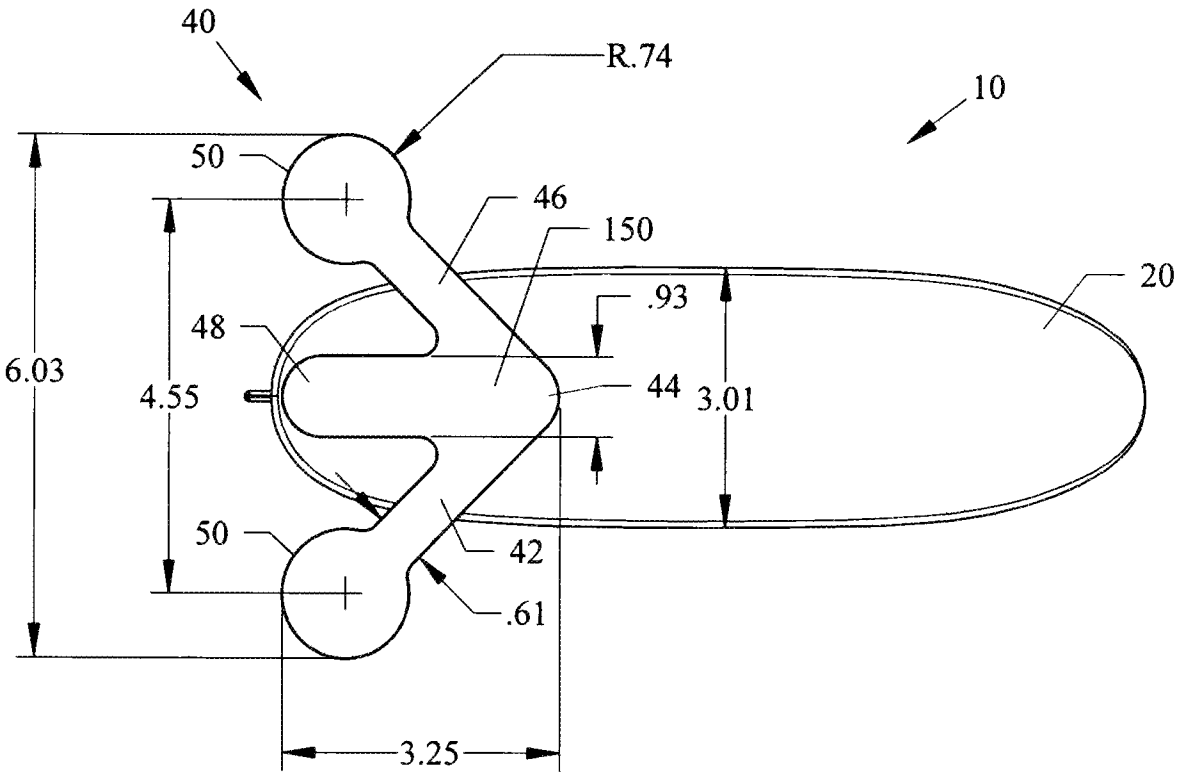
FIG. 7 is a bottom view of the surfboard toy of FIG. 1.
Figure 9:
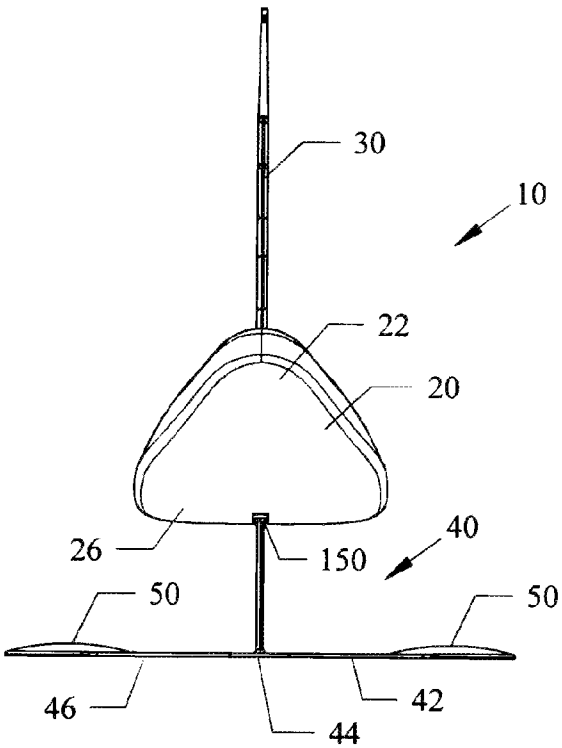
FIG. 9 is a front view of the surfboard toy of FIG. 1.
Figure 8:
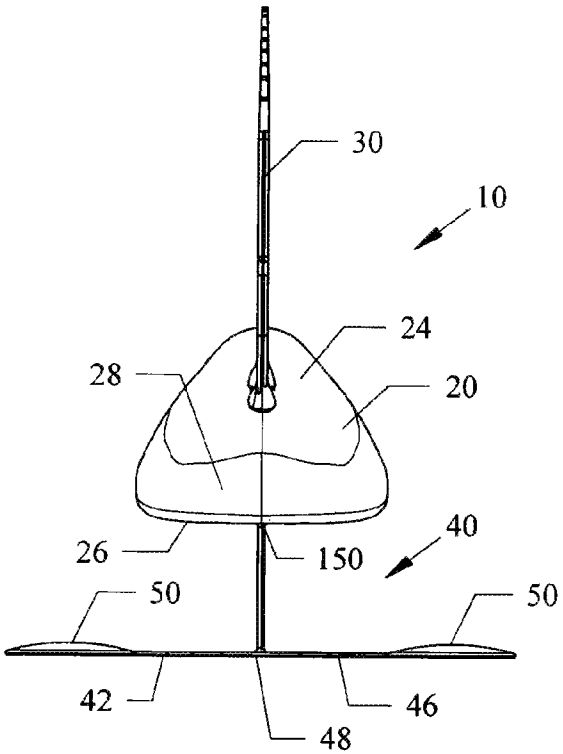
FIG. 8 is a rear view of the surfboard toy of FIG. 1.
Figure 11:
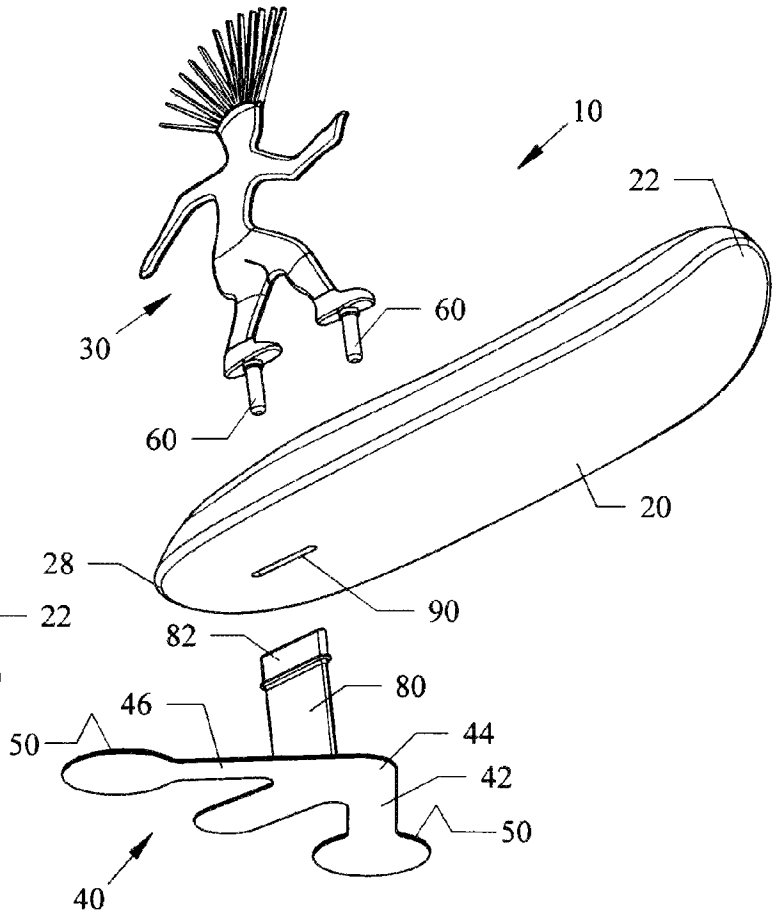
FIG. 11 is a bottom exploded perspective view of the surfboard toy of FIG. 1.
Figure 10:
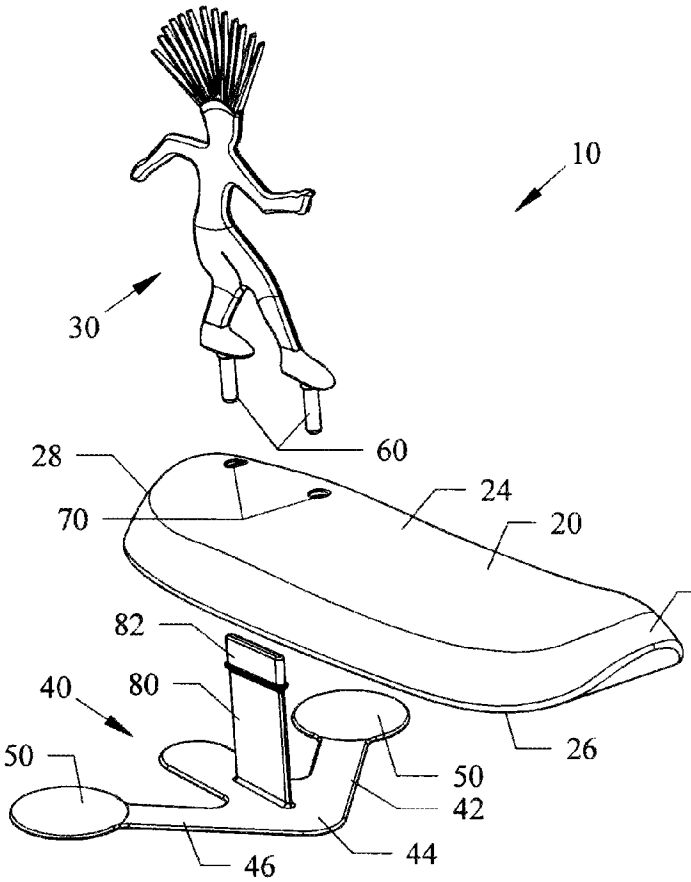
FIG. 10 is a top exploded perspective view of the surfboard toy of FIG. 1.

FIG. 5 is a side view of the surfboard toy 10 of FIG. 1 with dimensions of a preferred embodiment. FIG. 6 is a top view of the surfboard toy 10 of FIG. 1. FIG. 7 is a bottom view of the surfboard toy 10 of FIG. 1 with dimensions of a preferred embodiment. FIG. 8 is a rear view of the surfboard toy 10 of FIG. 1. FIG. 9 is a front view of the surfboard toy 10 of FIG. 1. FIG. 10 is a top exploded perspective view of the surfboard toy 10 of FIG. 1. FIG. 11 is a bottom exploded perspective view of the surfboard toy 10 of FIG. 1.

Surfboard 20

Referring to FIGS. 1-11, the novel surfboard toy 10 can include a floatation board 20 having a front upwardly curving end 22 with rounded tip and a rear end 28 with rounded edge with a top side 24 and bottom side 26. The floatation board 20 can be formed from injection molded foam, or foam rubber cut into a selected shape, or other lightweight material impervious to water. Alternatively, the board 20 can be formed from in injection molded plastic hollow housing with rubber placed inside the plastic shell.

Referring to FIGS. 5-7, the surfboard 20 can have dimensions of approximately 10.23 inches in length from the front end 22 to the rear end 28, and have a width of approximately 3.01 inches that tapers down at both the front end 22 and the rear end 28 to rounded tips. The thickness of the surfboard 20 can have a thickness of approximately 1.28 inches with the rear end 28 curving downward to an outer edge. The surfboard 20 has a generally flat bottom surface 26 that curves upward near the front end 22 in order to aid in lift of the surfboard when riding incoming waves.

Figurine 30

Referring to FIGS. 1-11 and mounted to the top surface 24 of the surfboard 20 adjacent to the rear end 28 can be surfer figurine 30 mounted thereon. The figurine 30 can have downwardly extending male members 60, such as pegs, that are insertable into figurine mounting holes (female receptacles) 70 on the top surface 24 of the surfboard 20 adjacent to the rear end 28 of the surfboard 20 as shown in FIGS. 10-11. The pegs 60 can be locked into the mounting holes 70 with waterproof glue or cement and the like.

Referring to FIG. 5, the figurine 30 can be formed from injection molded plastic and the like, and have a height from a foot portion mounted to the top surface 24 of the surfboard 20 to the top of the head portion to be approximately 4.62 inches and a width of approximately 3.72 inches between ends of the outstretched hands. Additionally, the figurine 30 can be formed from a lightweight foam so that it will stay upright easily while being pummeled by waves as the toy 10 is being used in the surf of incoming waves. The figurine can be narrow thin stick figure turned sideways so the plane of the planar shaped body is in the same plane as the keel/strut member 80 mounted underneath the board 20. The figurine 30 can be mounted almost directly above the keel/strut member 80.

Hydrofoil 40 and Keel/Strut Member 80

Referring to FIGS. 1-11, and mounted underneath the surfboard 20 adjacent to the rear end 28 can be a hydrofoil 40. A generally rectangular and narrow diameter keel type strut member 80 can be turned so that one side edge faces forward and the opposite side edge faces rearward. The keel/strut member can have a upper male member (tenon) that fits into a mateable slit 90 on the bottom surface 26 of the surfboard 20 adjacent to the rear end 28 of the surfboard 20 can be locked with waterproof glue or cement and the like.

Referring to FIG. 5, the keel/strut member 80 can have a height of approximately 1.59 inches between the bottom surface 26 of the surfboard and the top of the generally flat left wing/vane (not shown) and right wing/vane 47 of the hydrofoil 40.

Referring to FIGS. 1-11, the hydrofoil 40 can have a generally V or boomerang shape with a generally flat thin left wing/vane 42 connected to a generally flat thin right wing/vane 46 by a rounded/curved tip apex portion 44. The outer free ends of the left wing/vane 42 and right wing/vane 46 extend rearward from the apex portion and outward from the sides of the surfboard 20, and end in additional stabilizer/weighted curved portions 50. The wing end stabilizer/weighted portions 50 can be curve shaped and can include disc shapes and the like. The wing end stabilizer/weighted portions 50 can be slightly thicker with a slightly rounded top surface to add additional stabilizing weight to the hydrofoil 40. Extending rearward from the apex portion 44 can be an optional generally flat stabilizing tail rudder 46 located between the left wing/vane 42 and the right wing/vane 46.

Referring to FIGS. 5 and 7, the hydrofoil 40 can have an overall length between outer ends of the of outer stabilizing weights to be approximately 6.03 inches, and a length from the apex portion outer edge 44 to the outer end of the tail/rudder member 48 to be approximately 3.25 inches. Each of the wings/vanes 42, 46 can have a width of approximately 0.61 inches, with a width of the tail/rudder member 48 being approximately 0.93 inches. Each of the wing end stabilizers/weights 50 can have a radius of approximately R.74, and the distance between center points of each wing end stabilizers/weights 50 from one another can be approximately 4.55 inches.

The angle between the wings/vanes 42, 46 of the generally V shape or generally boomerang shaped hydrofoil 40 can range between approximately 10 to approximately 120 degrees. A narrower range can be between approximately 22 to approximately 60 degrees, and a narrower range of a preferred embodiment can range between approximately 35 to approximately 5 degrees.

Both the keel/strut member 80 and the hydrofoil 40 can be formed from hardened plastic, that was injection molded, and can include metal layer imbedded within the plastic. The weight of the keel/strut 80 and hydrofoil 40 can be approximately 1.3 ounces, while the entire weight of the figurine 30, surfboard 20 and keel/strut member 80 with hydrofoil 40 can be approximately 2.2 ounces. As such, the weight of keel/strut member 80 and the hydrofoil 40 can easily counter-balance the lighter weight of the figurine 30 in order to keep the surfboard toy 10 in an upright floating position.

The plane of the wings 42, 46 of the hydrofoil to the generally flat bottom surface 26 of the surfboard can be slightly angled so that the bottom surface 26 of the surfboard 20 angles upward toward the front end 22 approximately 6 degrees.

The figurine 30 can be mounted to be approximately perpendicular to the top surface 24 of the surfboard 20. The generally flat top surface 24 of the surfboard 20 can have an angle of approximately 95 degrees relative to the flat wings 42, 46 of the hydrofoil 40.

The dimensions referenced in a preferred embodiment shown and described in relation to FIGS. 5 and 7 are approximate. The term "approximately" can be +/−10% of the dimension numbers referenced for the preferred embodiment. The dimensions come from a preferred embodiment that has been tested in the ocean by the inventor to an effective working embodiment.

While FIGS. 5 and 7 show a preferred embodiment dimensions, the invention can use alternative dimensions when the toy is scaled up or scaled down to different sizes such as small as approximately 3 inches long as desired by the user.

Method of Playing with the Surfboard Toy

Figure 12:
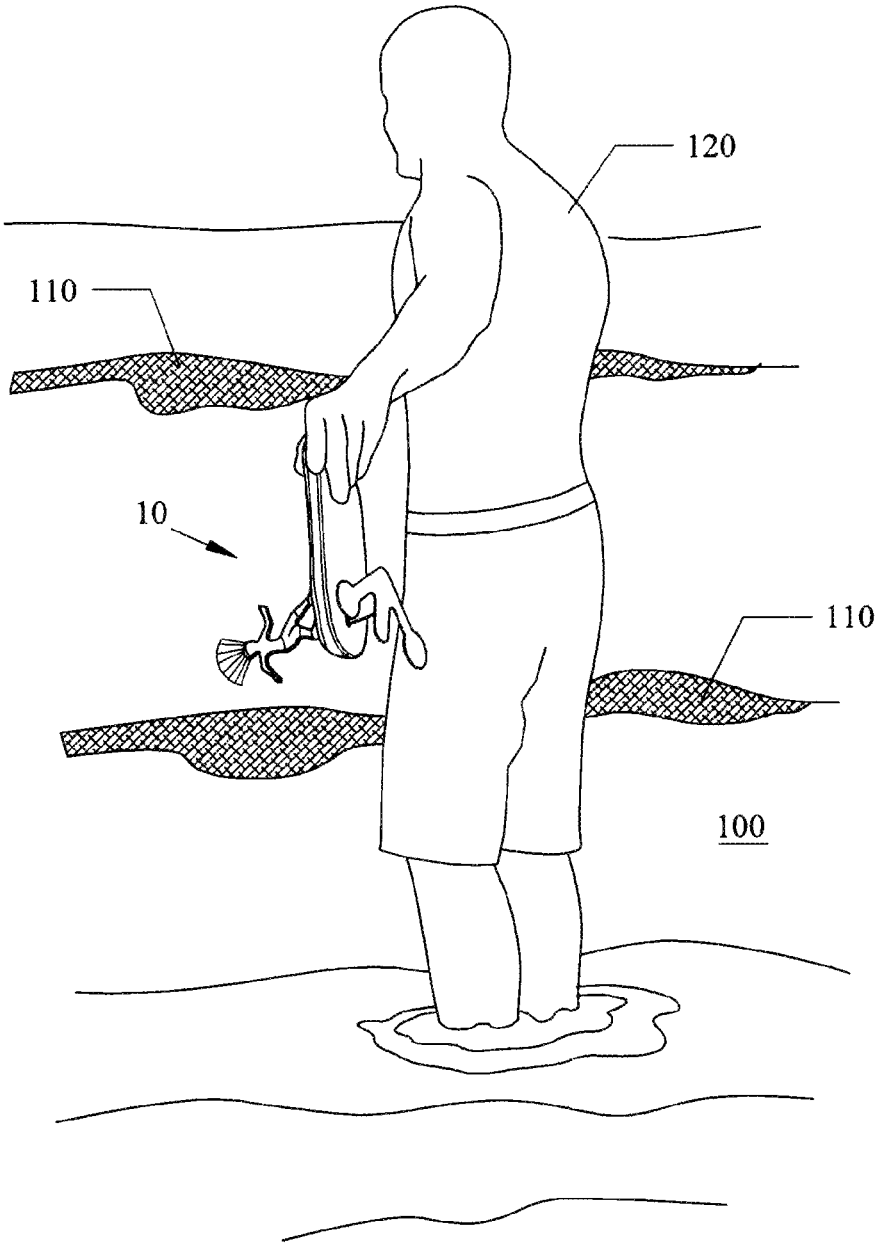
FIG. 12 shows a user on the back-swing of throwing a surfboard toy of FIG. 1 into the breaking surf from a shoreline.
Figure 13:
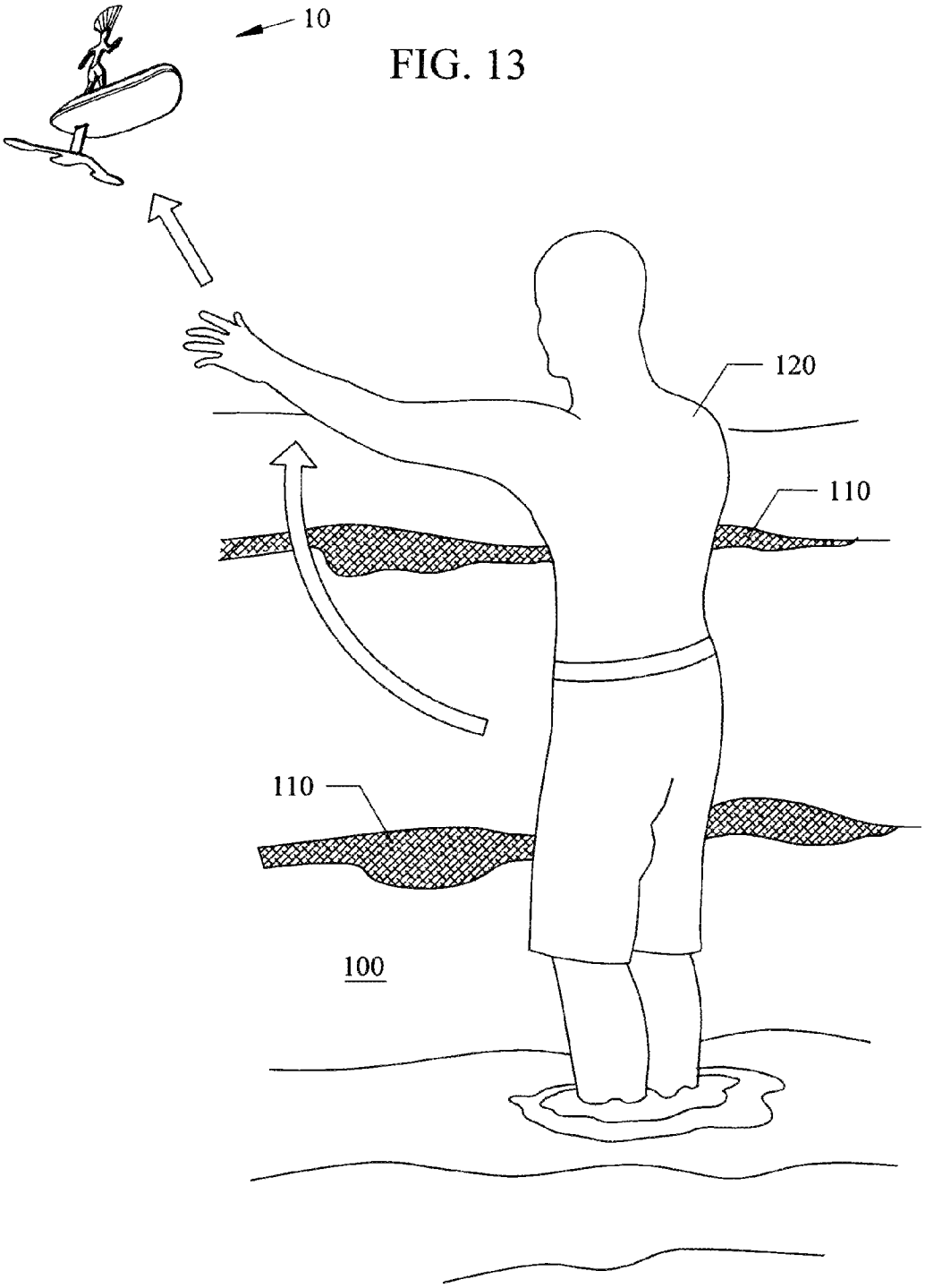
FIG. 13 shows the person in FIG. 12 throwing a toy into the breaking surf.

FIG. 12 shows a user 120 standing adjacent to a shoreline near the shore surf 100 and on the back-swing of throwing a surfboard toy 10 of FIG. 1 into the breaking surf 110. FIG. 13 shows the user 120 in FIG. 12 throwing the toy surfboard 10 into the breaking surf 110.

Figure 14:
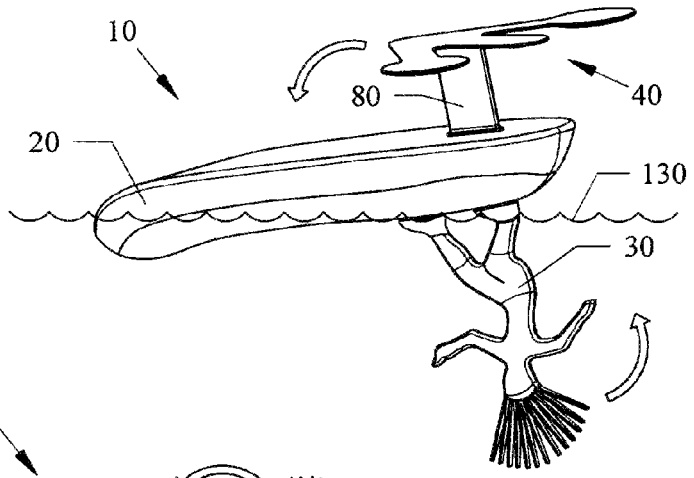
FIG. 14 shows the toy of FIG. 13 just after landing upside-down in the breaking surf.
Figure 15:
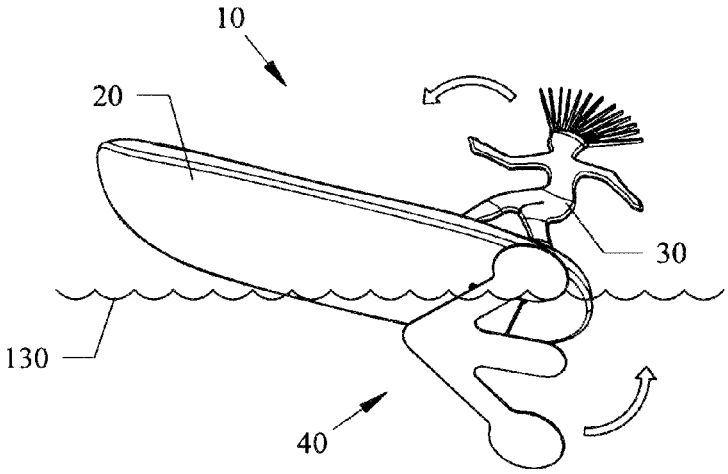
FIG. 15 shows the beginning of the self righting ability of the toy in FIG. 14.
Figure 16:
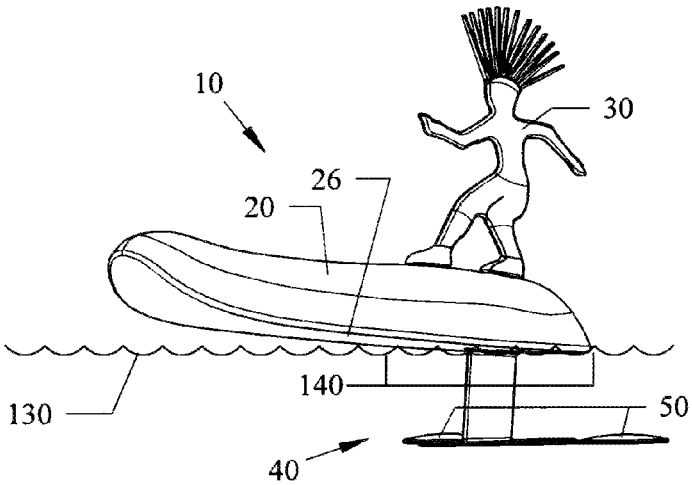
FIG. 16 shows the toy of FIG. 15 fully upright. Floatation zone is noted.

FIG. 14 shows the toy 10 of FIG. 13 just after landing upside-down in the breaking surf and resting on the water line 130. FIG. 15 shows the beginning the self righting ability of the toy 10 in FIG. 14. The weighted keel 80 and hydrofoil 40 will always insure that the surfboard toy 10 stays upright. FIG. 16 shows the toy 10 of FIG. 15 fully upright. Floatation zone is noted where a rear portion of the bottom surface 26 of the surfboard 20 can float on the water line 130 with the weighted hydrofoil 40 below the waterline 130.

Figure 17:
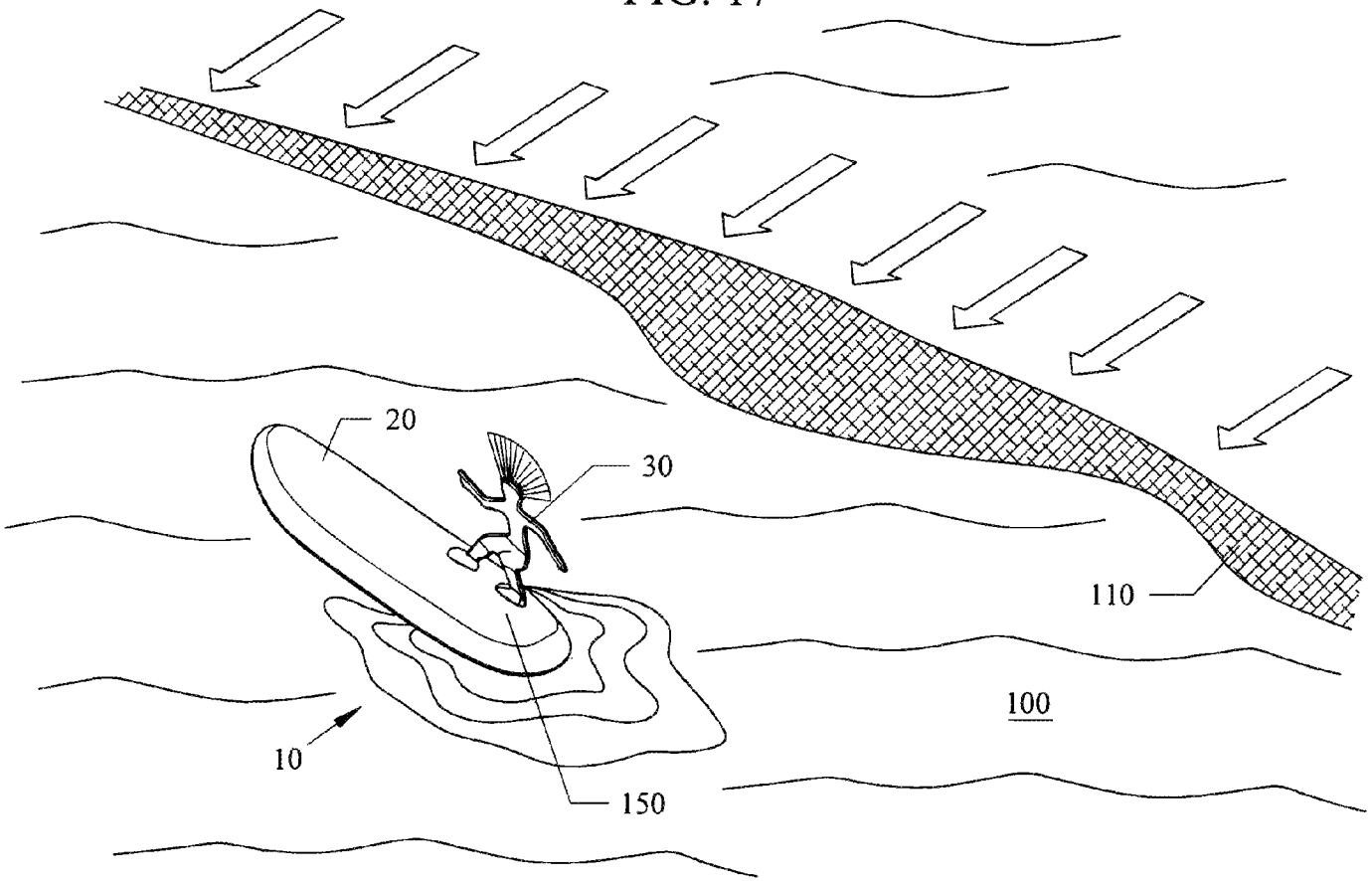
FIG. 17 shows the toy of FIG. 16 floating in the breaking surf with its side to the oncoming waves.

FIG. 17 shows the toy 10 of FIG. 16 floating in the breaking surf 100 with its side to the oncoming waves 110.

Figure 18:
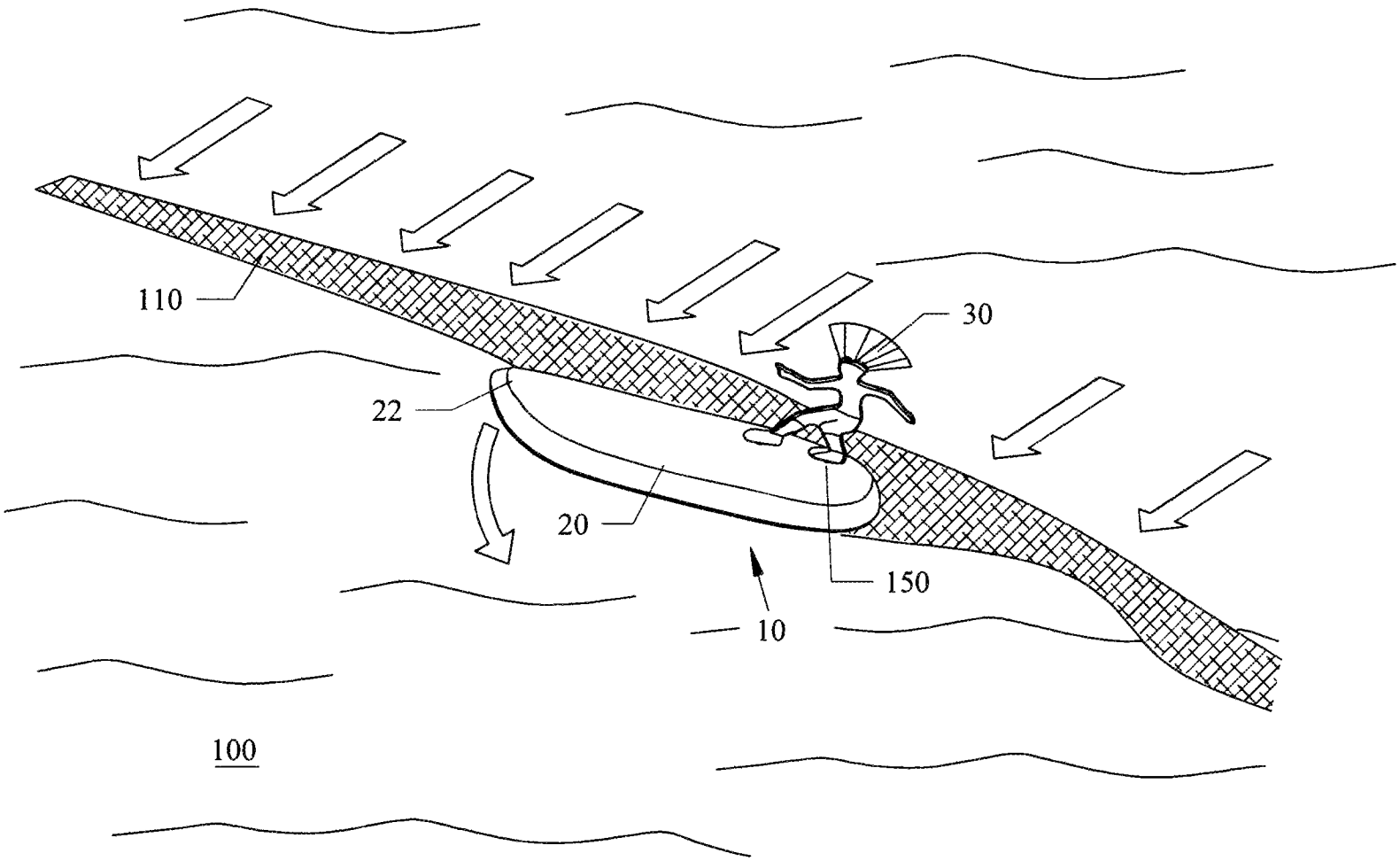
FIG. 18 shows the toy of FIG. 17 just being caught by a breaking wave. The front three quarters of the board float free of the water allowing the assembly to rotate about the floatation zone as the wave exerts its influence. This naturally points the nose of the floatation board in the direction of wave travel.
Figure 19:
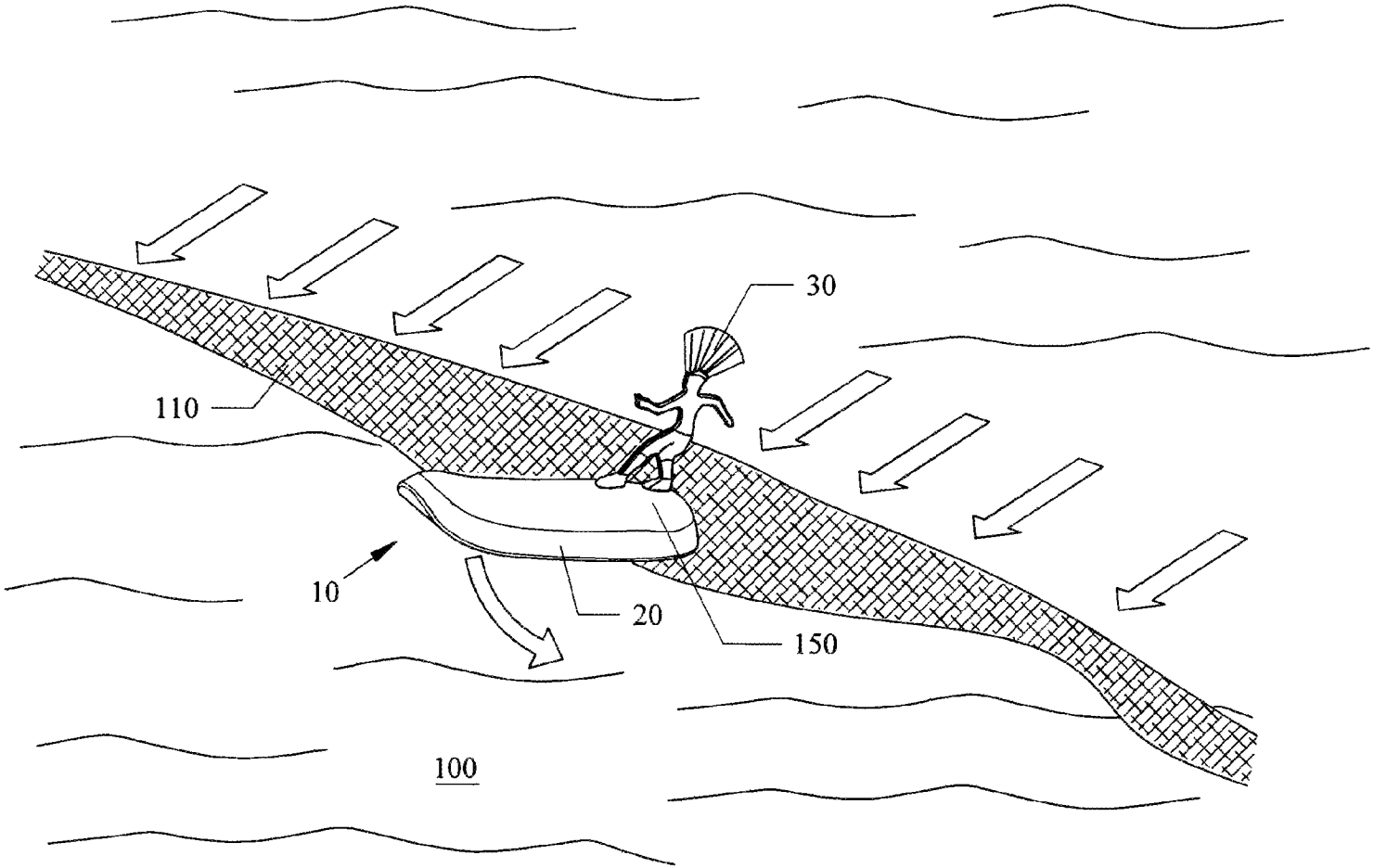
FIG. 19 shows the toy of FIG. 18 continuing to rotate influenced by the breaking wave.

FIG. 18 shows the toy 10 of FIG. 17 just being caught by a breaking wave 110. The front three quarters of the board 20 float free of the water allowing the toy 10 to rotate about the floatation zone 140 as the wave exerts its influence. This naturally points the nose (front end) 22 of the floatation board 20 in the direction of wave travel and pivots at a pivot point 150. FIG. 19 shows the toy 10 of FIG. 18 continuing to rotate influenced by the breaking wave 110.

Figure 20:
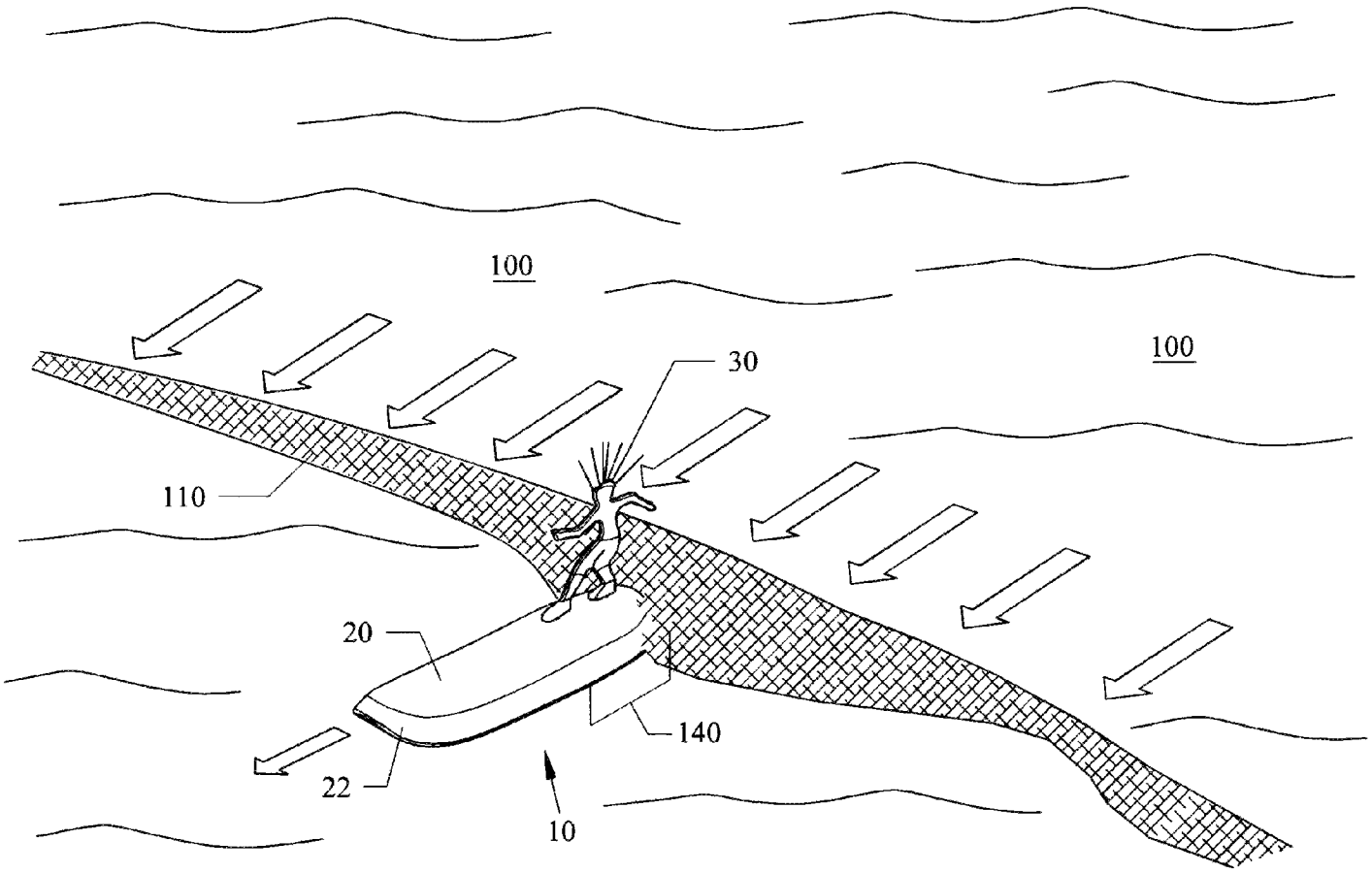
FIG. 20 shows the toy of FIG. 19 has full oriented itself with its nose in the direction of wave travel and is "surfing" on the breaking wave.

FIG. 20 shows the toy 10 of FIG. 19 has full oriented itself with its nose 22 in the direction of wave travel and is "surfing" on the breaking wave 110.

Figure 21:
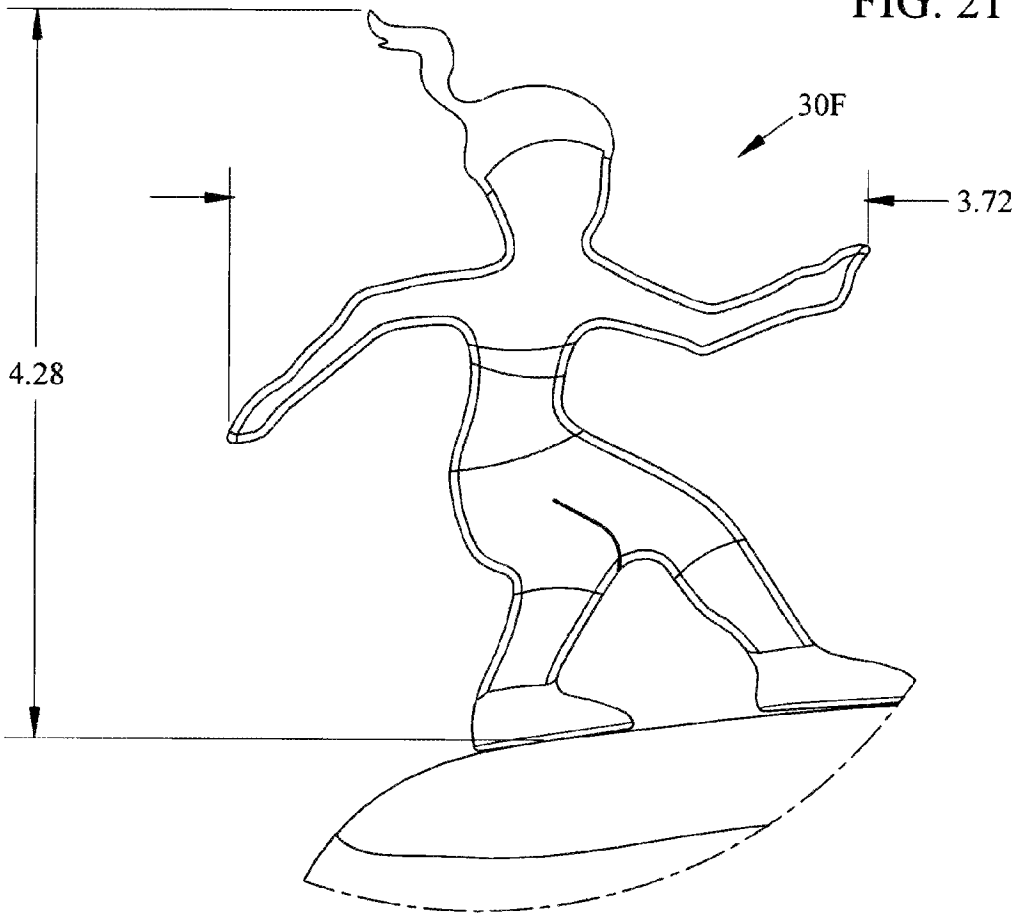
FIG. 21 is an enlarged view of an alternative figurine that can be mounted on the surfboard toy of FIG. 1.

FIG. 21 is an enlarged view of an alternative figurine 30F that can be mounted on the surfboard toy 10 of FIG. 1. The figurine 30F can have similar dimensions to the previously described figurine 30.

Additional games that can take place with the novel surfboard toys 10 can include two or more players tossing or throwing generally identical surfboard toys 10 into the surf and determining a winner when the first surfboard toy 10 reaches the shoreline.

Second Embodiment

FIG. 22 is an exploded view of another embodiment of the surfboard toy 200 with figurine 230, board 205, skeg 240 and main wing 270. FIG. 23 is a side assembled view of the surfboard toy 200 with figurine 230, board 205, skeg 240 and main wing 270 of FIG. 22. FIG. 24 is a front view of the assembled surfboard toy 200 of FIG. 23. FIG. 25 is a rear view of the assembled surfboard toy 200 of FIG. 23. Figurine 230, board 205, skeg 240 and main wing 270 can be formed from similar materials to similar components described in the previous embodiment. For example, figurine 230 can be formed from an injection molded hard plastic, and board 205 can be formed from EVA (ethylene vinyl acetate) foam.

FIG. 26 is a cross-sectional view of the assembled surfboard 200 of FIG. 23 along arrows 26X. FIG. 27 is a side cross-sectional view of the assembled surfboard 200 of FIG. 24 along arrows 27X.

FIG. 28 is an enlarged perspective view of the separated figurine 230 of the previous figures. FIG. 29 is a side view of the figurine 230 of FIG. 28. FIG. 30 is a front view of the figurine 230 of FIG. 28. FIG. 31 is a rear view of the figurine 230 of FIG. 28.

Referring to FIGS. 28-31, the figurine 230 be similar to the surfer figurine 30 of the previous embodiment, with some main differences. Figurine 230 can included rounded hair tip ends 231, which are less sharp and safer than the hair ends in the previous embodiment, and curved hand portions with rounded ends 239 which are also less sharp and safer than those in the previous embodiment.

Figurine 230 can include a downwardly extending front cylindrical male peg 232, with parallel ribs 233 on the front face, and a flat surface 234 under the front foot, and a downwardly extending rear square (or rectangular) male peg 236 with parallel ribs 237 on the front face and a flat surface 238 under rear foot.

FIG. 32 is an enlarged perspective view of the separated surfboard 205 of FIGS. 22-27. FIG. 33 is a top view of the surfboard 205 of FIG. 33. FIG. 34 is a bottom view of the surfboard 205 of FIG. 33.

Referring to FIGS. 23 and 32-34, board 205 can have a board top 210 with a front generally beveled tip edge 212, and an upwardly angling tip 213, and a generally flat top surface 214. Tip edge 212 can have a slight beveling instead of being arced in the previous embodiment. Here, the tip edge is more perpendicular to the bottom with a small arc at the top of the tip edge 212. Board 205 can also have a front cylindrical through-hole 215 and a rear square (or rectangular) through-hole 216 both adjacent to a rear end of the board 205. Board 205 can also have a rounded upper rear surface edge 217 and a generally flat rear end 218 with rounded beveled upper side edges 219 on both sides of the board 205.

The board bottom 220 can have a flat upwardly angling front surface 222 with a rounded transition surface 223, and a generally flat lower surface 224. Down the middle of the board bottom 220 adjacent to rear end of the board 205 can be a longitudinal indentation 226 with a angled front tip indentation 227 and a flat rear indentation 228.

The lower rear surface 224 of the board 205 (also shown in FIG. 23) can have an approximately 9 degree angle that can beginning approximately 0.75 inches in from the end 218 of the board 205 sloping up to the end 218 of the board 205.

FIG. 35 is an enlarged perspective view of the separated keel/strut member (skeg) 240 of FIGS. 22-27. FIG. 35A is a bottom view of the skeg 240 of FIG. 35 along arrow 35X. FIG. 36 is a side view of the skeg 240 from FIG. 35 assembled to the separate main wing 270 of FIGS. 22-27.

Referring to FIGS. 22, 23, and 27, main wing 270 can be at a downward 5 degree (+/−2 degrees) angle from board 205 on a perpendicular 90 degree upward angle through skeg 240 and a 35 degree (+/−5 degrees) to the front 212 of board 205.

Referring to FIGS. 35-36, skeg 240 can include an upwardly extending front cylindrical tube 242 with socket, having an upper edge which rests generally flush with (or slightly recessed from) upper (top) board surface 210 when assembled. The upper ends of the tubes 242, 246 can be tapered (narrower) to allow for ease in inserting into the through-holes 215, 216 in the board 205. Front tube 242 can have parallel slits/slots 243 in the front face, and an upwardly extending rear square (or rectangular) tube 246 with socket having an upper edge which rests generally flush with (or slightly recessed from) upper (top) board surface 210 when assembled. Rear tube 246 can have parallel slits/slots 247 in the front face. The tubes 242, 246 can raise upward from a flat upper ledge surface 244 that has a narrow tip end and a generally flat rear end which can mateably fit into the longitudinal indentation 226 in the board bottom 220.

The strut portion 250 of the skeg 240 can have a front concave curved edge 252 and a rear convex curved edge 256. Strut portion 250 can have an enlarged lower footer 258 with a male connector 260 extending downward therefrom. The male connector 260 can have a front split step 262 which protrudes from a longitudinal split fin portion 264 and longitudinal side rib(s) 266 can face sideways from the longitudinal split fin portion 264.

FIG. 37 is a top view of the separate wing 270 of FIGS. 22-27 and 36. FIG. 38 is a bottom view of the wing 270 of FIG. 37. FIG. 39 is a side view of the wing 270 of FIG. 37 along arrow 39X.

Referring to FIGS. 37-39, main wing 270 can include a front convex edge 272 with a rear extending left wing/vane 274 and an enlarged rounded (weighted) end 275, and a rear right wing/vane 276 with an enlarged rounded (weighted) end 277. The weighted portions can be additional material such as metal, and/or weighted discs that can be imbedded therein, and/or more plastic type material for the added weight which provide ballast for helping maintain the surfboard toy in an upright position when be used in the ocean as described in the previous embodiment.

Wing 270 can also include a central rear extending tail 280 with a rounded tip end 281. The root end of tail 280 can have concave edges 282 with sculpted indented surfaces 284 located about the concave root end edges 282

A through-hole mounting slot 286 can be located through a mid-portion of the wing between the left vane 274 and right vane 276, with a front end indentation step 287 in the wing top, and side indentation steps 288 along the sides of the slot 286 in the wing bottom.

A raised footer 285 can have a pedestal type shape with flat bottom and be located under the front of main wing 270 near the apex portion. Footer 285 allows for the assembled toy surfboard 200 to be balanced when placed on a flat surface for display purposes.

Table 1 lists preferred dimensions of the board 205, FIG. 230, skeg 240 and main wing 270 used with the toy surfboard 200.

TABLE 1

| Surfboard toy component dimensions | | | |
|---|---|---|---|
| Component description | Acceptable range | Narrowed range | Preferred dimension |
| in inches: | | | |
| Surfboard, length | 7.0000-12.0000 | 8.5000-11.5000 | 11.0236 |
| Surfboard, width | 2.1250-3.6429 | 2.5804-3.4911 | 3.3465 |
| Surfboard, depth or thickness (measured at rear, before bevel, or at midpoint of board) | 0.6750-1.1572 | 0.8197-1.1089 | 1.0630 |
| Male figure, height (peg bottom to top of hair) | 3.7306-6.3954 | 4.5301-6.1289 | 5.8750 |

TABLE 1-continued

| Surfboard toy component dimensions | | | |
|---|---|---|---|
| Component description | Acceptable range | Narrowed range | Preferred dimension |
| Male figure, width (front hand to back hand) | 2.5400-4.3543 | 3.0843-4.1729 | 4.0000 |
| Male figure, thickness (rear foot puddle) | 0.3572-0.6123 | 0.4337-0.5868 | 0.5625 |
| Male figure, thickness (torso) | 0.0794-0.1361 | 0.0964-0.1304 | 0.1250 |
| Skeg, height (front to back) | 1.7463-2.9936 | 2.1205-2.8688 | 2.7500 |
| Skeg, width (top to bottom) | 1.8256-3.1296 | 2.2168-2.9992 | 2.8750 |
| Skeg, depth (side to side) | 0.3572-0.6123 | 0.4337-0.5868 | 0.5625 |
| Wing, length (side to side) | 3.8100-6.5314 | 4.6264-6.2593 | 6.0000 |
| Wing, width (front to back) | 1.9050-3.2657 | 2.3132-3.1296 | 3.0000 |
| Wing, depth (weighted sides or vanes) | 0.1588-0.2721 | 0.1928-0.2608 | 0.2500 |
| Wing, depth (including bottom souvenir bump) | 0.2381-0.4082 | 0.2892-0.3912 | 0.3750 |
| in millimeters: | | | |
| Surfboard, length | 178-305 | 216-292 | 280 |
| Surfboard, width | 54-93 | 66-89 | 85 |
| Surfboard, depth or thickness (measured at rear, before bevel, or at midpoint of board) | 17-29 | 21-28 | 27 |
| Male figure, height (peg bottom to top of hair) | 95-162 | 115-156 | 149 |
| Male figure, width (front hand to back hand) | 65-111 | 78-106 | 102 |
| Male figure, thickness (rear foot puddle) | 9-16 | 11-15 | 14 |
| Male figure, thickness (torso) | 2-3 | 2-3 | 3 |
| Skeg, height (front to back) | 44-76 | 54-73 | 70 |
| Skeg, width (top to bottom) | 46-79 | 56-76 | 73 |
| Skeg, depth (side to side) | 9-16 | 11-15 | 14 |
| Wing, length (side to side) | 97-166 | 118-159 | 152 |
| Wing, width (front to back) | 48-83 | 59-79 | 76 |
| Wing, depth (weighted sides or vanes) | 4-7 | 5-7 | 6 |
| Wing, depth (including bottom souvenir bump) | 6-10 | 7-10 | 10 |

Table 2 lists preferred weights of the board 205, FIG. 230, skeg 240 and main wing 270 used with the toy surfboard 200.

TABLE 2

| Surfboard toy component weights | | | |
|---|---|---|---|
| Component description | Acceptable range | Narrowed range | Preferred dimension |
| in ounces: | | | |
| Surfboard only | 0.7-1.3 | 0.8-1.2 | 1.1 |
| Male figure | 0.4-0.8 | 0.5-0.7 | 0.7 |
| Skeg | 0.3-0.5 | 0.3-0.5 | 0.4 |
| Wing, including stability weights | 1.2-2.2 | 1.5-2.1 | 1.9 |
| Wing, excluding stability weights | 0.8-1.5 | 1.0-1.4 | 1.3 |
| Male figure | 0.4-0.8 | 0.5-0.7 | 0.7 |
| All toy components combined | 2.6-4.8 | 3.1-4.5 | 4.1 |
| in grams: | | | |
| Surfboard only | 19.2-36.3 | 23.4-34.8 | 30.3 |
| Male figure | 12.4-21.2 | 15.0-20.3 | 19.5 |
| Skeg | 7.9-14.3 | 9.6-13.7 | 12.5 |
| Wing, including stability weights | 33.7-60.6 | 40.9-58.1 | 53.0 |
| Wing, excluding stability weights | 22.9-41.1 | 27.8-39.4 | 36.0 |
| All toy components combined | 73.2-132.4 | 88.9-126.9 | 115.3 |

The assembly of the toy surfboard 200 will now be described with the figurine 230 mounted to the top 210 of the board 205, and the skeg mounted to the bottom 220 of the board 205, with the main wing 270 mounted to the bottom of the skeg 240 as shown by the arrows in FIG. 22.

Referring to FIGS. 22-36, the upwardly extending cylindrical tube 242 and square (or rectangular) tube 246 of skeg 240 can be pushed into the cylindrical through-hole 215 and square (or rectangular) through-hole 216 in the bottom 220 of the board 2015 until the flat ledge 244 rests against the flat bottom 224 recessed therein within indentation 226. The locations of the square hole 216 and cylindrical hole 215 force the assembler to only use the correct holes 215, 216 when assembling the skeg 240 to the board 205.

Next, the assembler can mount the wing 270 to the bottom of the skeg 240 in reference to FIGS. 22-39. The assembler can place the assembled board 205 and skeg 240 upside down on a surface. The top surface of wing 270 can be positioned such that the front end indentation step 287 is placed over front split step 262 and longitudinal split fin portion 264 is aligned into the rest of through-hole slot 286. The outer facing edges of the longitudinal split fin portion 264 can be tapered to more easily fit into the slot 286.

Next the assembler can push the wing 270 so that the slip fin portion 264 passes into the slot 286 which causes the split fin portion to be pinched together. The assembler can push until the longitudinal side facing ribs 266 of split fin portion 264 snap about side indentation steps 288 locking the wing 270 in place. Similarly, the split step can also pinch together and rest against step 287.

Next the lower extending cylindrical peg 232 and square (or rectangular) peg 236 of the figurine 230 are passed into the top 210 of the board 205, and their locations also force the assembler to use the proper through-holes 215, 216 for assembly. The raised ribs 233, 237 in the respective pegs 232, 236 can snap into mateable slits/slots 243, 247 in the respective tubes 242, 246, which locks the figurine 230 to the top 210 of the board 205, and the skeg 240 to the bottom 220 of the board 205.

The novel invention shown and described in the second embodiment allows for many additional benefits.

If the toy were stepped upon after it is assembled, the connection of skeg 240 and wing 270 would snap apart and not fracture, yet the figurine with board and skeg and wing is still strong enough to ensure that the wing (or hydrofoil) will not become unattached in normal play in surf and waves.

In addition, the novel surfboard toy can only be assembled in one orientation, ensuring that the consumer assembles the surfing toy in the correct orientation.

The redesign of the connecting mechanism results in the skeg having a rear square channel and a round front channel, which match a new rear square and front round peg in the figure. In addition, the surfboard can have two holes, one square at the rear, and one round toward the front, to match the design of both the skeg and the figurine.

This redesign ensures that the toy is assembled properly such that the figure and the skeg are logically inserted into the surfboard and their connection in only one orientation. In addition, the square peg of the figure cannot physically be inserted into the round hole of the receptor channel of the skeg.

The second embodiment can include a new downward pointing "split arrowhead" connector between the skeg and the wing or hydrofoil.

The first embodiment combined the "strut" (now called a skeg) and wing, or hydrofoil, into a single piece. This would have allowed the single piece construction, which consisted of two perpendicular planar surfaces, to potentially fracture if the toy were stepped on, which fractured piece could have resulted in a sharp edge.

The second embodiment splits these planar surfaces into two separate pieces and introduces a new "breakaway" split arrowhead (which is a split construction such that the space between the two sides of the "split arrowhead" condenses during insertion into the wing (or hydrofoil), then, once inserted, pops back open to secure the connection that is designed to "breakaway" if the toy were stepped upon, which connection is still strong enough to ensure that the wing (or hydrofoil) will not become unattached in normal play in surf and waves.

In addition, the second embodiment can only be assembled in one orientation, ensuring that the consumer assembles the surfing toy in the correct orientation.

The wing, or hydrofoil, was previously a flat, planar surface. The second embodiment smoothes the prior sharp angles and surfaces of the wing and thickens the wing/vanes of the first embodiment.

The revisions to shape and thickness, especially the "sculpting" of the wing in the second embodiment, promotes much better and more consistent surfing performance, catching random turbulence in the currents of waves which produces more "yawing" motion, which "yawing" motion is corrected by the new unitized design, causing more tricks to be performed during each surfing session, while more consistently keeping the surfboard toy in its natural upright surfing position on top of the surf and wave, perfecting the self-righting capability of the toy in surf.

The second embodiment can include weighted members, such as but not limited to two weighted disks that can be inserted into the wing, or hydrofoil, during its injection molding manufacturing process that precisely weight and balance, or stabilize, the wing and toy.

Additional tests during the further design and prototyping of the second embodiment toy surfboard revealed that precise weighting added to each wing vane, which weights were chrome-plated (to discourage rusting in water use) and inserted during the manufacturing (injection molding) process would result in much better and more consistent surfing performance, including more consistent righting of the surfboard toy on any inversion in the surf, helping to ensure the toy inverts to its natural upright position to resume its surfing session.

In addition, the rear weighting of the toy, combined with the increased upward angle of the nose of the surfboard and overall heavier weight of the toy, avoids the previous embodiment's tendency to "pearl" or submerge its nose as it acquired a wave.

In the second embodiment the weight of the wing was increased by over 75% from the previous embodiment 1.3 ounces (for the combined strut/keel and hydrofoil) to a combined weight for the skeg and wing (hydrofoil) of approximately 2.3 ounces.

The increased weight, and precise stabilization through the ballast weighting system, promotes the optimum combination of trick performance while surfing and ensuring the surfboard toy returns to its natural upright position whenever surf conditions invert the toy during a surfing session.

The second embodiment adds a bump to the front bottom of the wing such that the surfboard toy, when displayed after a surfing session in one's home or office, will sit upright.

The increased back weighting of the toy surfboard and increased angles promote better surfing performance and required the addition of a "souvenir bump" at the front edge of the wing to ensure the surfboard toy would sit upright when displayed on a dresser or credenza in a home bedroom or at an office after use on the beach.

Although the embodiment shows tubes with sockets extending upward from the skeg and male pegs extending downward from the figurine, the components can be reversed such that the tubes can extend downward from the figurine, and male pegs can extend upward from the skeg.

Although the embodiment shows a cylindrical hole in front and square (or rectangular) hole toward the rear, the locations of the respective geometrical shaped holes, can be reversed. Additionally, other shapes, such as but not limited to other geometrical shapes, such as but not limited to triangle shapes, hexagon, shapes, and the like can be used. Additionally less than or more than two side slits/slots, can be used, and different types of snaps can be used such as but not limited to raised protrusion locking into a small cylindrical hole, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A surfboard toy, comprising:

an elongated surfboard with front and rear ends, and top and bottom surfaces;

a figurine being attachable and detachable to the top surface adjacent to the rear end of the surfboard, the figurine having a figurine weight;

a skeg having an upper end and a lower end, the upper end is attachable and detachable to the bottom surface of the surfboard underneath the figurine; and a main wing with a left rearward extending vane and a right rearward extending vane, wherein a mid portion of the main wing is attachable and detachable to the lower end of the skeg, the main wing having a weight heavier than the weight of the figurine so as to cause the surfboard toy to move to a standup position in water.

2. The surfboard toy of claim 1, wherein the figurine includes downwardly facing connectors extending therefrom, and the skeg includes upwardly extending connectors, and the surfboard includes through-holes so that the downwardly extending connectors and the upwardly extending connectors mateably attach to one another in the through-holes through the surfboard.

3. The surfboard toy of claim 2, wherein the downwardly facing connectors and upwardly extending connectors include male members and female slot members.

4. The surfboard toy of claim 2, wherein the through-holes include different shaped through-holes to correspond to different shaped connectors that allow only for assembly of the figurine in one facing direction on the surfboard and for the skeg and the main wing in one facing direction to the surfboard.

5. The surfboard toy of claim 1, wherein the main wing includes:

a tail portion between the left vane and the right vane, wherein the left vane and the right vane and the tail portion form a generally E shape.

6. The surfboard toy of claim 1, wherein the main wing includes: a longitudinal slot which allows for the wing to be mounted about a raised connector portion on the lower end of the skeg.

7. The surfboard toy of claim 6, wherein the raised connector portion on the skeg includes: a split fin portion, which is adaptable to pinch together when the split portion is pushed into the longitudinal slot.

8. The surfboard toy of claim 7, wherein the longitudinal slot includes a step indentation on one end of the longitudinal slot in a top side of the wing, and a step portion on the split fin portion for fitting against the step indentation.

9. The surfboard toy of claim 8, wherein the longitudinal slot includes side indentations along both sides of the longitudinal slot in a bottom side of the wing, and raised ribs on both sides of the split fin portion.

10. The surfboard toy of claim 1, wherein the left vane and the right vane each include enlarged weighted end portions.

11. The surfboard toy of claim 1, further comprising:

a raised member on a lower surface of the wing adjacent to an apex portion, for allowing the surfboard toy to remain in an upright position when placed on a flat surface.

12. A method of assembling a surfboard toy, comprising the steps of:

providing an elongated surfboard with front and rear ends, and a pair of through-holes through the surfboard;

providing a figurine with a pair of downward protruding connector members;

providing a skeg with upward protruding connector members;

providing a wing;

mounting the figurine to a top of the surfboard and the skeg to the bottom of the surfboard by passing the downward connector members and the upward connector members into the through-holes until the downward connector members and the upward connector members lock with one another; and mounting the wing to a bottom of the skeg.

13. The method of claim 12, wherein the mounting the wing step includes the steps of:

providing a longitudinal slot in the wing;

providing a split fin portion extending from the bottom of the skeg; and pushing the wing against the bottom of the skeg until the split fin pinches together and snaps into the longitudinal slot locking the wing to the skeg.

14. The method of claim 12, further comprising the steps of: providing the longitudinal slot with a step indentation on one end of the longitudinal slot in a top side of the wing; and providing a step portion on the split fin portion for fitting against the step indentation.

15. The method of claim 14, further comprising the steps of: providing the longitudinal slot with side indentation ledges along both sides of the longitudinal slot in a bottom side of the wing; and providing raised ribs on both sides of the split fin portion; and pushing the split fin portion into the slot so that the raised ribs press together and snap around the side indention ledges.

16. The method of claim 12, further comprising the steps of:

providing the wing with a left vane and a right vane; and providing the left vane and the right vane each with enlarged weighted end portions.

17. The method of claim 12, further comprising the steps of:

providing the wing with a left vane and a right vane; and providing the left vane and the right vane with a tail portion extending therebetween forming a general E shape.

18. The method of claim 12, further comprising the step of:

providing a raised member on a lower surface of the wing adjacent to an apex portion, for allowing the surfboard toy to remain in an upright position when placed on a flat surface.

* * * * *